US006723033B1

(12) United States Patent
Scott et al.

(10) Patent No.: US 6,723,033 B1
(45) Date of Patent: Apr. 20, 2004

(54) METHOD AND APPARATUS FOR PRODUCING PARTICLE BEARING FILTER ROD

(75) Inventors: George Robert Scott, Midlothian, VA (US); Charles Gary Atwell, Mechanicsville, VA (US); Martin T. Garthaffner, Chesterfield, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/517,720

(22) Filed: Mar. 2, 2000

Related U.S. Application Data

(60) Provisional application No. 60/122,507, filed on Mar. 2, 1999.

(51) Int. Cl.[7] ..... B31C 13/00

(52) U.S. Cl. ..... 493/48; 493/44; 493/47; 493/42; 141/67

(58) Field of Search ..... 131/58, 88, 202, 131/280; 141/11, 67, 69, 70, 125, 144

(56) References Cited

U.S. PATENT DOCUMENTS

| | | | | |
|---|---|---|---|---|
| 3,312,151 A | | 4/1967 | Molins | |
| 3,312,152 A | | 4/1967 | Williamson | |
| 3,340,775 A | | 9/1967 | Raymond et al. | |
| 3,348,455 A | | 10/1967 | Williamson et al. | |
| 3,550,508 A | | 12/1970 | Wartman, Jr. et al. | |
| 3,570,557 A | | 3/1971 | Molins | |
| 3,623,404 A | | 11/1971 | Jackson | |
| 3,625,118 A | | 12/1971 | Jackson | |
| 3,807,286 A | | 4/1974 | Sexstone | |
| 3,844,200 A | | 10/1974 | Sexstone | |
| 3,884,741 A | | 5/1975 | Sexstone | |
| 3,941,036 A | * | 3/1976 | Molins et al. | 131/84.2 |
| 3,943,832 A | | 3/1976 | Sexstone | |
| 3,957,563 A | | 5/1976 | Sexstone | |
| 4,005,668 A | | 2/1977 | Washington et al. | |
| 4,016,830 A | | 4/1977 | Sexstone | |
| 4,020,881 A | | 5/1977 | Nöthen | |
| 4,090,424 A | | 5/1978 | Hall | |
| 4,106,535 A | | 8/1978 | Davis | |
| 4,174,720 A | | 11/1979 | Hall | |
| 4,184,412 A | | 1/1980 | Hall | |
| 4,208,956 A | | 6/1980 | Hall | |
| 4,214,508 A | | 7/1980 | Washington | |
| 4,412,829 A | | 11/1983 | Lebet et al. | |
| 4,425,107 A | | 1/1984 | Hall | |
| 4,661,090 A | * | 4/1987 | Arthur | 493/42 |
| 4,861,324 A | | 8/1989 | Hirose et al. | |
| 4,949,766 A | | 8/1990 | Coatsworth | |
| 4,973,503 A | * | 11/1990 | Hotchkiss | 138/137 |
| 5,234,397 A | * | 8/1993 | Wahle et al. | 493/4 |
| 5,282,779 A | * | 2/1994 | Sakai et al. | 28/276 |
| 5,322,495 A | | 6/1994 | Budjinski, II et al. | |
| 5,875,824 A | | 3/1999 | Atwell et al. | |

* cited by examiner

*Primary Examiner*—Rinaldi I. Rada
*Assistant Examiner*—Louis Tran
(74) *Attorney, Agent, or Firm*—Burns, Doane, Swecker & Mathis, LLP

(57) ABSTRACT

A method and apparatus for delivering predetermined amounts of particulate material and/or plasticizer to a location remote from the particulate material, and a cigarette filter and a cigarette made according to the method and apparatus.

29 Claims, 17 Drawing Sheets

METHOD AND APPARATUS FOR PRODUCING PARTICLE BEARING FILTER ROD

The present application claims benefit under 35 U.S.C.§ 119(e) to U.S. Provisional application No. 60/122,507, filed Mar. 2, 1999.

FIELD OF INVENTION

The present invention relates generally to methods and apparatus for accurately delivering precisely metered amounts of particulate material repetitively during high speed manufacture of particulate bearing articles of manufacture, more particularly, to precise, repetitive delivery of granular particles such as charcoal and/or silica gel or other material to spaced locations along a continuous, moving stream of bundled filaments comprising cellulose acetate or other forms of tow.

BACKGROUND OF THE INVENTION

Certain articles of manufacture such as particle bearing cigarette filters, individual-sized packets of granular food products or condiments, capsuled pharmaceuticals, ammunition and the like require repetitive placement of precisely metered charges of particulate matter at some location along the production-line procession of the articles. Difficulties arise in pursuing sufficient speed in the mass production of such articles without sacrificing consistency, damaging the material and/or exacerbating spillage, particularly at elevated manufacturing speeds where ricochet and vibration may impair process control and consistency.

With machines of the prior art, process control usually suffers at high machine speeds from inconsistent metering and pulverization of the material, particularly in those prior machines where fast moving machine components are allowed to impinge stationary or relatively slow moving particulate material. For example, certain prior particle metering devices contain a supply of particle in a hopper and allow the rim of a rotating metering wheel to rotate through the relatively stationary collection of particle. Such an arrangement creates a pulverizing action upon the particle which generally increases with machine speed.

Excessive pulverization of the particulate material may alter the qualities of the final product unacceptably. Ricochet and escape of particulate matter during manufacturing operations with prior machines often create unacceptable deficiencies in the final product (such as smears or incomplete fillings) and precipitate undesirable machine "downtimes" to effect clean-up of the machine and the surrounding work environment.

It is also known from the prior art that the manufacture of cigarette filters, particularly the commonly used cigarette filters made of a cellular acetate tow, that the processing of the tow presents various difficulties. For example, the tow has very little tensile strength and, therefore, special handling techniques must be devised to avoid stretching the tow. Further, when drawing the tow around rollers, the fibers of the tow furthest from the roller tend to be stretched relative to the fibers closest to the roller. After the tow has passed the roller, the stretching of the fibers tends to cause the tow to remain in a curved or bent condition.

It is known to apply a plasticizing agent to fibrous cellulose acetate during production of filter rods. It is further known from the prior art that application of plasticizer material close to particulate material in cigarette filters can case at least partial deactivization of the particulate material if the plasticizer migrates to the particulate material.

An object of the present invention is to provide a method and apparatus capable of precisely metering discrete amounts of particular material at high machine speeds.

Another object of the present invention is to provide a method and apparatus which executes high speed delivery of metered amounts of particulate material without pulverization of the material even at high operational speeds.

Yet another object of the present invention is to provide an apparatus for delivering particulate material, which minimizes shearing action upon the particulate material.

Still another object of the present invention is to provide a method and apparatus which minimizes shear upon the particulate material by maintaining low relative velocities between the particulate material and portions of the machine coming into contact with the particulate material.

Another object of the present invention is to provide a method and apparatus which transfers particulate material with the assistance of vacuum so as to minimize scatter and promote consistency even at high machine speeds.

Still another object of the present invention is to provide a method and apparatus for high speed delivery of particulate material with minimal escape of the material.

Yet another object of the present invention is to provide a method and apparatus for accurately delivering precisely metered amounts of particulate material repetitively during high speed manufacture of particulate bearing articles of manufacture, and most particularly, to precise, repetitive delivery of granular particles such as particle and/or silica gel or other material to spaced locations along a continuous, moving stream of bundled filaments comprising cellulose acetate or other forms of tow.

Still another object of the present invention is the provision of method and apparatus that permits low tensile strength material such as cellular acetate tow to be processed under minimal tension.

Still another object of the present invention is the provision of a method and apparatus that permits low tensile strength material such as cellular acetate tow to be processed in equipment having rollers around which the tow travels without causing excessive stretching of the tow so as to minimize tendency of the tow to retain a bended shape.

Still another object of the present invention is the provision of a method and apparatus for making a cigarette filter in which precisely metered amounts of particulate material are delivered and retained in a continuous filter rod in which plasticizer is applied to the cigarette filter at locations remote from the particulate material.

SUMMARY OF THE INVENTION

These and other objects are achieved with the present invention which is embodied in an arrangement for the production of particle bearing cigarette filters. Such apparatus and method includes a tow treatment apparatus arranged to produce a continuous stream of fibrous material; a fibrous rod maker at a second location downstream of the tow treatment apparatus for wrapping the plug wrap about the continuous stream of fibrous material and sealing same; a particle inserter operative at a location between the rod maker and the tow treatment apparatus for inserting predetermined, metered amounts of particles in spaced, discrete locations along the continuous stream of fibrous material; and a cutter downstream of the filter rod maker for cutting the continuous, particle bearing, fibrous rod into discrete rod plugs.

In particular, the particles are delivered by first establishing a continuous stream of fibrous material along a feed path; establishing a flow of particles along a first path; moving a first pocket along an endless path at least partially coinciding with the first path; drawing an amount of the particles into the pocket as the pocket moves in proximate relationship with the particles flow; transferring the drawn amount of particles from the first pocket to a second pocket while moving the second pocket along a second endless path which coincides with the feed path at a release location; forming a pocket-like recess in a portion of the continuous stream of fibrous material adjacent the release location; releasing the drawn amount of particles from the second pocket into the recessed portion of the continuous stream of fibrous material at the release location; and subsequently closingly folding adjacent portions of the continuous stream of fibrous material about the released, drawn amount of particles.

Preferably, particles are retained with the assistance of vacuum application to the pocket-like recess at the release location and at least during a first portion of the closing step.

In addition, or in the alternative, a filter bearing spaced-apart amounts of plasticizer can be manufactured by a method and in a system wherein a continuous strand of fibrous material is established, the continuous strand of fibrous material is moved past a plasticizer delivery point, and a plasticizer is intermittently applied to the continuous strand of fibrous material at application points on the continuous strand of fibrous material as the application points move past the delivery location. Vacuum is communicated to the locations so as to promote migration of plasticizer into the tow at the locations and to limit migration of the plasticizer outside of the locations.

BRIEF DESCRIPTION OF THE DRAWING

These and other objects and advantages of the invention will become apparent upon the consideration of the following detailed description, taken in conjunction with the accompanying drawings, in which each particular reference numeral consistently refers to particular parts throughout. The following figures are included.

DETAILED DESCRIPTION OF THE PREFERRED EMBODIMENTS

Figure 1:
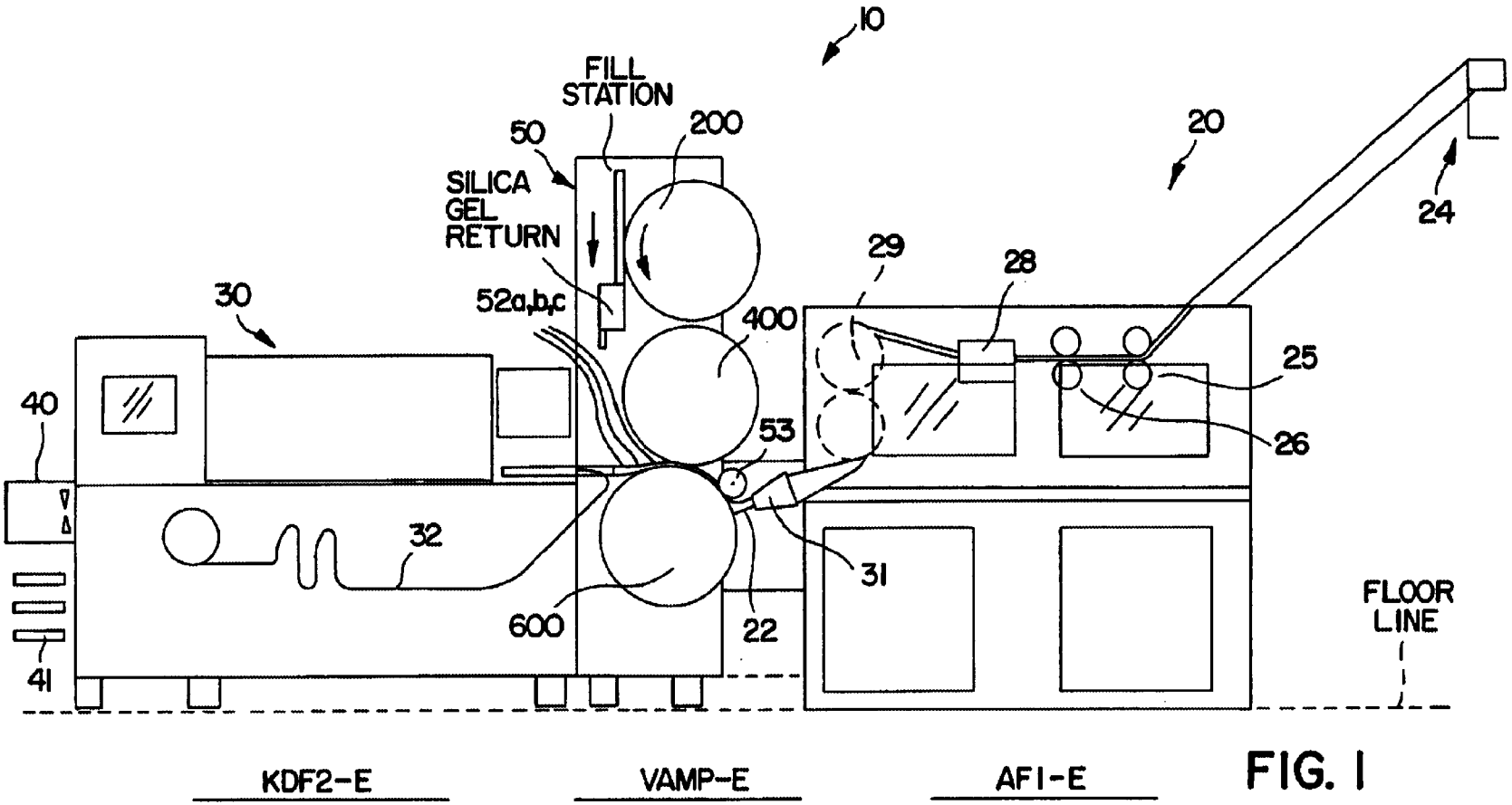
FIG. 1 is a schematic side view of a filter rod maker system constructed in accordance with an embodiment of the present invention.

Referring to FIG. 1, a preferred embodiment of the present invention includes a filter rod maker 10 which is capable of the high-speed construction of particle bearing filter rods at a rate of approximately 300 meters of filter rod per minute. The filter rod maker 10 comprises a tow treatment apparatus 20 for the generation of a continuous stream of filamentary material 22 such as by way of non-limiting example, cellulose acetate tow; a filter rod maker 30 located downstream of the tow treatment apparatus 20 for wrapping leading portions of a continuous plug wrap 32 about the continuous stream of filamentary material 22; a cutter 40 for slicing the continuous rod produced by the filter rod maker 30 into individual filter plugs of a predetermined length (usually a multiple of what constitutes a filter for a single cigarette); and a particle charger apparatus 50 operatively located between the tow treatment apparatus 20 and filter rod maker 30 which is arranged to consistently deliver predetermined amounts of particulate material (preferably comprising particles of charcoal and/or silica gel or other suitable material) into spaced apart locations 52 (for example locations 52*a*, 52*b* and 52*c* in FIG. 1) defined along the continuous stream of filamentary material 22 as established by the tow treatment apparatus 20.

The tow treatment apparatus 20 is mostly of a layout familiar to those of ordinary skill in the pertinent art, such as an AF1-E apparatus from Hauni-Körber AG of Hamburg, Germany. Such machines typically include a feed arm 24 for directing a continuous strand of tow material before a set of pretension rollers 25, a set of threaded, blooming rollers 26, a plasticizer applicator 28, a plurality of delivery rollers 29 and finally a transport stuffer jet 31, all which cooperate to form the continuous stream of filamentary material 22 at the exit of the tow treatment apparatus 20. In the preferred embodiment of the present invention, the output of the tow treatment apparatus 20 is fed under desired tension and rate into the particle charger apparatus 50, preferably with the assistance of a set of metering rollers 53. The plasticizer applied by the plasticizer applicator is preferably a softening agent added in small quantities to the cellular acetate tow to tack the fibers together at points where the filaments cross each other. Additionally, the transport jet 31 is modified, preferably in accordance with the description which follows with reference to FIG. 6 to establish a planar, ribbon-like shape to the continuous stream of filamentary material 22 at the exit of the transport jet 31.

Examples of plasticizers include, but are not limited to, triacetin (also known as glycerol triacetate, or PZ), trimethylene glycol diacetate (also known as TEGDA), and mixtures thereof.

Figure 2:
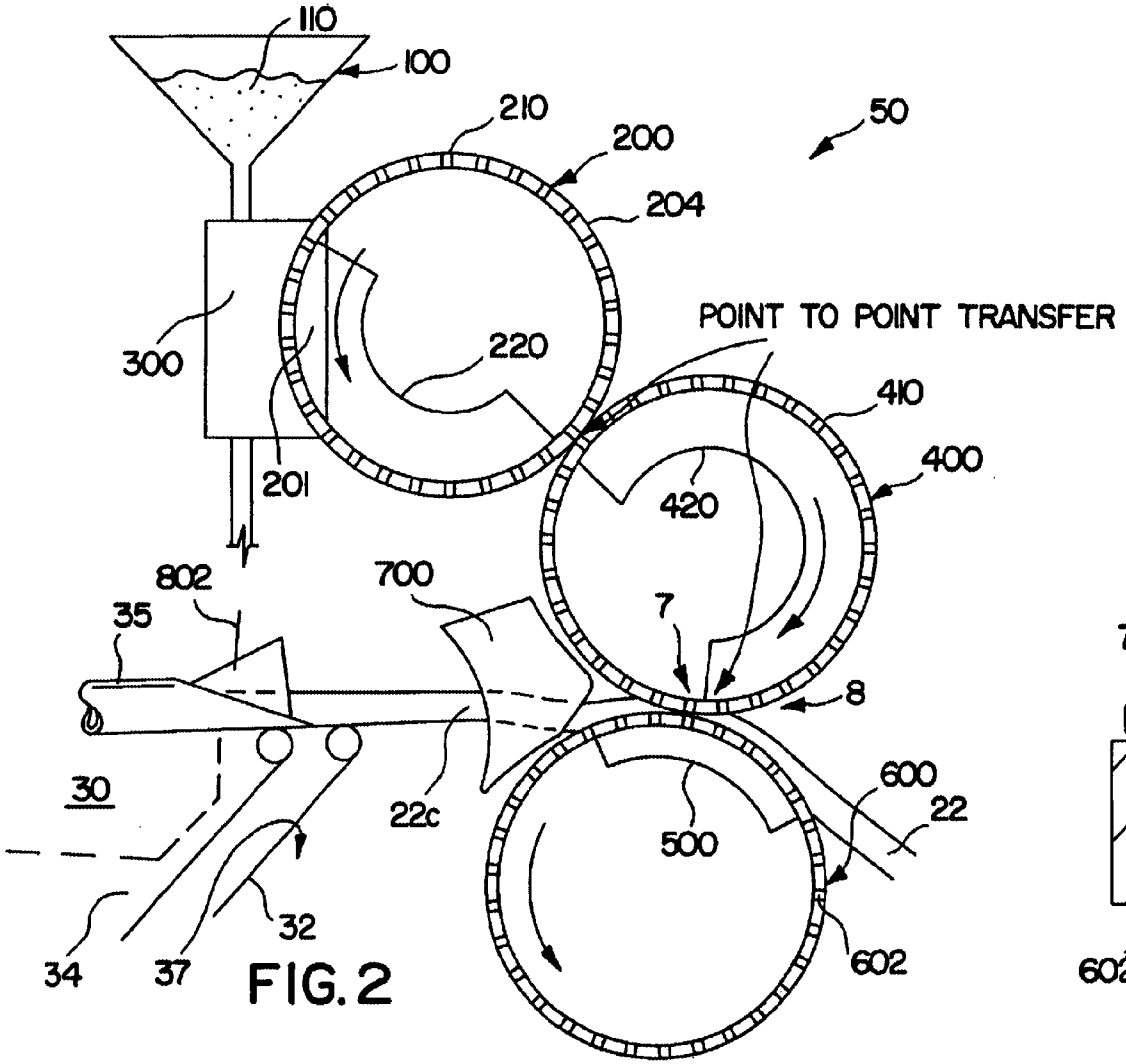
FIG. 2 is a schematic side view of a preferred particle charger apparatus of the filter rod maker of FIG. 1.
Figure 4:
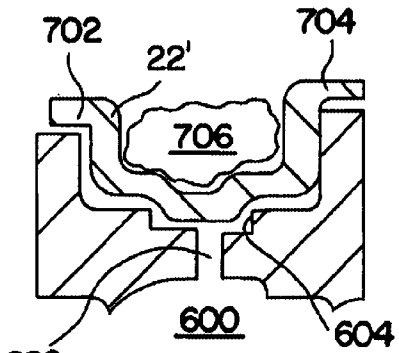
FIG. 4 is another detail view along arrow B in FIG. 2.

Referring now to FIGS. 1 and 2, the particle charger apparatus 50 preferably comprises a particle reservoir 100 for the retention of a supply of particulates 110; a metering wheel 200 having a plurality of spaced-apart, preferably conical pockets 210 along its rim 204 for receiving and releasing predetermined amounts (charges) of particle; a chute 300 in communication with the reservoir 100 and arranged to receive an edge portion 201 of the metering wheel 200 for directing a stream of particle from the reservoir 100 into a confluent relationship with the edge portion 201 of the rotatable metering wheel 200; a rotatable transfer wheel 400 having a plurality of spaced-apart, preferably conical pockets 410 along its rim 404 for repetitively receiving charges of particle from the metering wheel 200 and releasing same at a delivery location 7 defined at a predetermined angular location about the transfer wheel 400; a vacuum retention wheel 600 which includes a vacuum manifold 500 across the delivery location 7 for facilitating a complete and clean transfer of particles from the transfer wheel 400 to the adjacent portion of the continuous stream of filamentary material 22 at the delivery station 7; and preferably a folding shoe (or garniture) 700 just downstream of the wheels 400 and 600, which is arranged to close edge portions 702 and 704 about a delivered charge of particles 706.

Figure 3A:
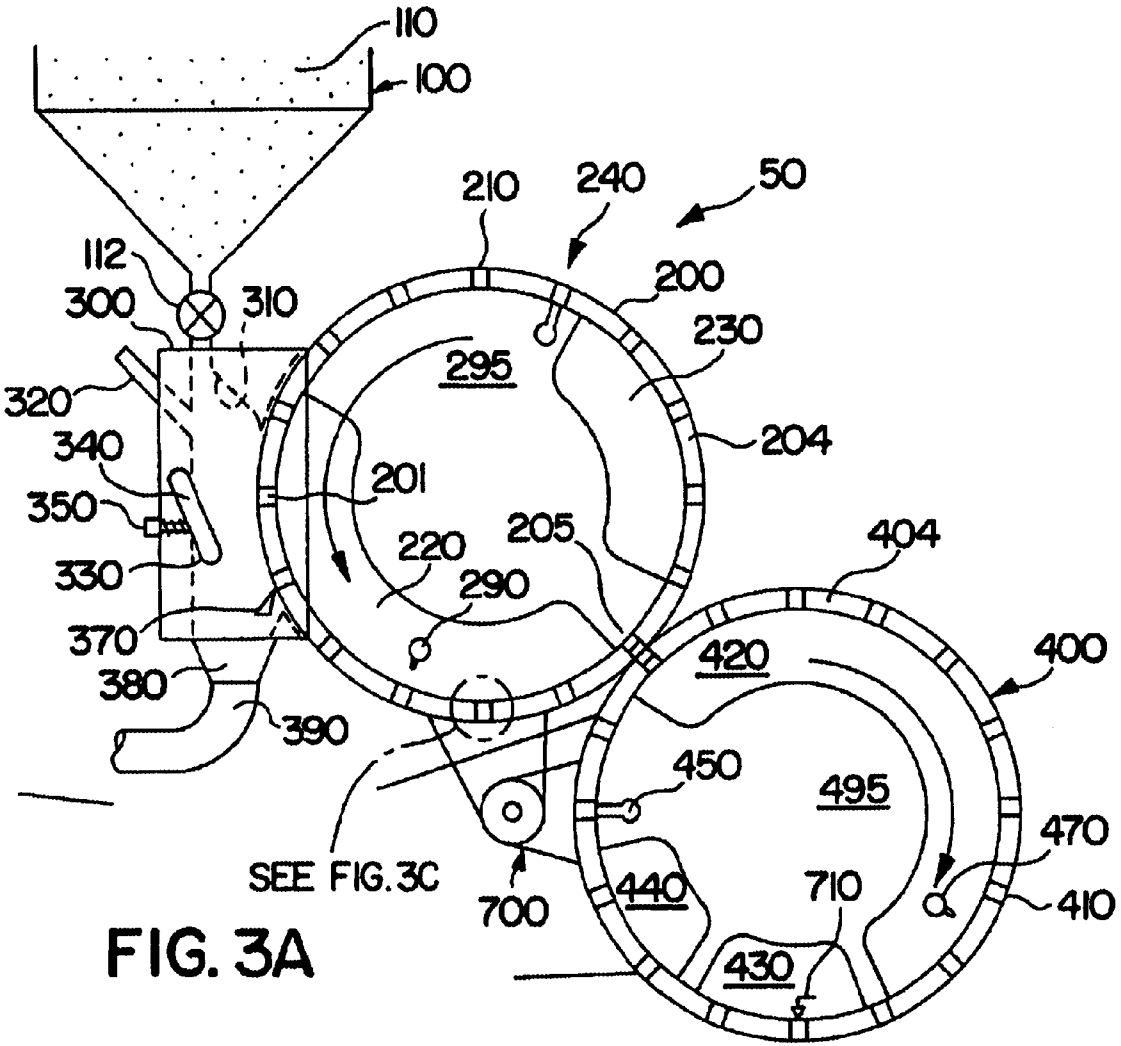
FIG. 3A is a detailed, partially cut-away side view of the metering wheel of the particle charger apparatus of FIG. 2.
Figure 3C:
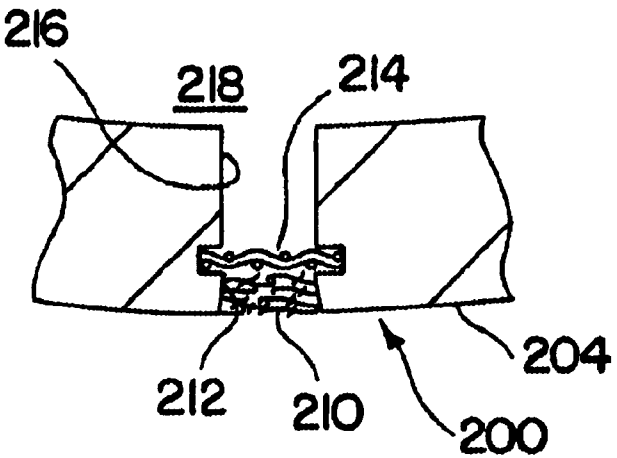
FIG. 3C is a sectional detail taken along line C—C in FIG. 3A.

Referring particularly FIGS. 3A and 3C, the rim 204 of the metering wheel 200 includes a plurality of equally spaced-apart pockets 210, each of which are defined by a radially directed, conical bore 212 and a screen 214 at the terminis of the conical bore 212. The conical bore 212 is convergent in the radially inward direction. A radially directed channel 216 within the rim 204 communicates a backside of the screen 214 with the interior of the metering wheel 200. The arrangement is such that when a vacuum is communicated from a vacuum plenum 220 located along an interior portion of the wheel 200 through the passageway 216 and screen 214, any particle that is adjacent the pocket 210 particle will be drawn into the conical bore 212 of the pocket 210 until it is filled. The space enclosed by the screen 214 and the conical bore 212 define the volumetric capacity of each pocket 210.

Optionally, the screen 214 is affixed upon a threaded ring or upon a ring that engages selectable annular spacers so that the radial position of each screen 214 may be adjusted to accommodate delivery of a selectable range of volumetric quantities of particle.

The chute 300 is in communication with the reservoir 100 of granular particle such that the particles can be controllably passed from the reservoir 100 through the chute 300 under the influence of gravity. At a location along the internal passage way 310 through the chute 300, a vent 320 is arranged to admit ambient air into the passageway 310 as the particulate particle 110 is drawn under vacuum from the chute 300 into the pockets 210 of the metering wheel 200. At a second location along the passage way 310 below the vent 320 is situated a baffle 330, which is arranged along the passage way 310 so as to deflect the stream of entrained particle toward the adjacent edge portion 201 of the metering wheel 200. The chute 300 preferably includes a doctoring blade 370 at a location along the passage way 310 near where the rim 304 of the metering wheel exits the chute 300 and is operative upon the metering wheel 200 so as to remove any extra granular particle that extend beyond the confines of the pockets 210 as the metering wheel 200 rotates the pocket out 210 of the chute 300. Such arrangement assures a consistent and clean filling of the pockets 210 as they are rotated through the chute 300. The doctored (extra) particle is redirected back into the passageway 310. At the exit of the passageway 310, a trap 380 receives the granular particle that was not collected by the metering wheel 200, which duct 380 is in communication with the appropriate arrangement 390 for returning the uncollected particle to the reservoir 100.

A shut-off valve 112 is positioned operatively between the reservoir 100 and the entrance to the chute 300. Optionally, the shut-off valve 112 could be configured as a metering valve or the like.

Fixed within the confines of the metering wheel 200 is a first vacuum plenum 220 which is operative about an angular extent of the wheel 200 beginning where particle is collected from the chute 300 and ending at an angular transfer location 205 where particle is transferred from the wheel 200 to the wheel 400. The vacuum plenum 220 is connected to a vacuum source through ducting and preferably extends from an approximately 10 o'clock angular position along the rim 204 just prior to entry of the rim 210 into the chute 300 to an approximately 5 o'clock angular position along the rim 204, where the rim 204 of the metering wheel 200 converges with the rim 404 of the transfer wheel 400. As each pocket 210 passes along the vacuum plenum 220, vacuum within the plenum 220 is communicated through the channel 216 of the pocket so that particle is drawn into and retained by the pocket 210. Accordingly, as the individual pocket 210 passes along the plenum 220, it is subjected to negative pressure tending to draw granular particle into the pocket 210 as it passes through the chute 300 and retains the pocket-load of granular particle until such time that the pocket 210 passes the angular transfer location 205 (the 5 o'clock position), whereupon communication with the vacuum is relieved. After further rotation of the rim 204, the pocket 210 is then communicated with a second vacuum plenum 230 so that any material lingering in the pocket 210 is retained within the pocket 210 until such time that the pocket 210 arrives at the purging station 240 (at or about a 2 o'clock position on the metering wheel 200), where a positive flow is directed through the channel 216 of the pocket 210 so as to cleanse the pocket 210 of any extraneous matter before the pocket returns to the chute 300. Any material removed at the purging station is collected so as to avoid contamination of product and the machine 10.

As the pockets 210 move across angular positions outside of the first and second plenums 220 and 230, the internal drum structure 295 within the wheel blocks off the channel 216 from communication with the plenums 220 and 230.

The internal drum structure 495 within the transfer wheel 400 is provided between the plenum 420 in similar fashion with respect to the pockets 410 at the rim 404 of the transfer wheel 400.

As each loaded pocket 210 is rotated beyond the end of the vacuum plenum 220 (the 5 o'clock position), the communication of vacuum is interrupted such that the particle within the pocket 210 may be readily removed and transferred to one of the pockets 410 located at space locations about the rim 404 of the transfer wheel 400. The transfer wheel 400 rotates in a direction opposite of the metering wheel 200 and its rim 404 passes by the rim 204 with clearance of approximately 4 millimeter at an angular location of approximately 11 o'clock on the transfer wheel 400.

The rim 404 of the metering wheel 400 includes a plurality of equally spaced-apart pockets 410, each of which are constructed in similar fashion to the pockets 210 of the metering wheel 200. Referring particularly to FIG. 3C, with the understanding that the last two digits in designations of comparable elements are the same, each pocket 410 includes a radially directed, conical bore 412 and a screen 414 at the terminis of the conical bore 412. The conical bore 412 is convergent in the radially inward direction and of slightly larger diameter than the conical bore 212 of the metering wheel 200. A radially directed channel 416 within the rim 404 communicates a backside of the screen 414 with the interior of the transfer wheel 400.

Further details concerning the structure and cooperation of the chute, the metering wheel and the delivery wheel is provided in U.S. Pat. No. 5,875,824, and is hereby expressly incorporated by reference in its entirety.

Figure 3B:
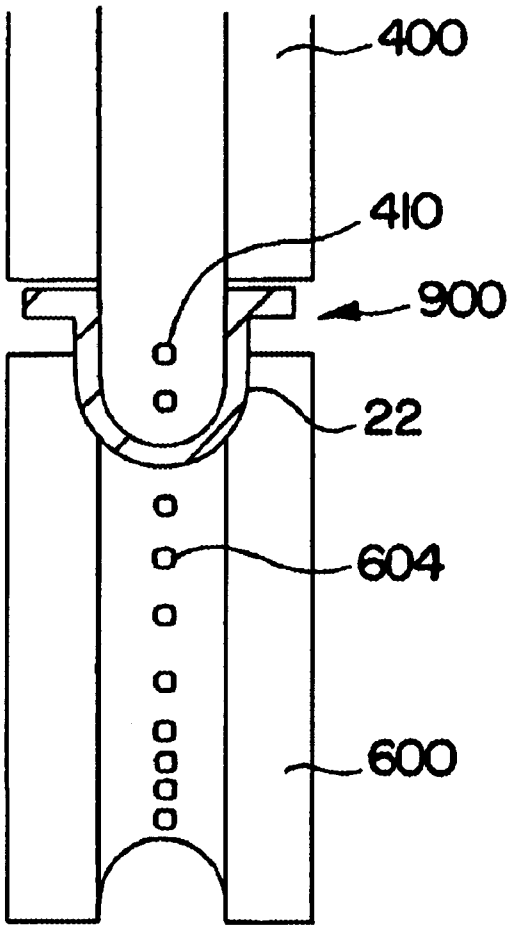
FIG. 3B is a detail view along arrow B in FIG. 2.

Referring now to FIG. 3*b*, just upstream of the 6 o'clock angular location on the transfer wheel 400, the rim 404 of the wheel 400 comes into contact with the continuous stream of filamentary material 22. Preferably, the transfer wheel 400 and the vacuum retention wheel 600 include meshing portions 900 relative to one another such that a generally U-shaped pocket form is imparted to the continuous stream of filamentary material 22 as same passes through the nip defined between the wheels 400 and 600 at and adjacent to the delivery position 7. To further assist in the receipt and retention of particle charges at the delivery position 7, vacuum is applied to the underside of the folded filament 22' to assist in the positive and complete delivery of the particle charge 706 and to retain same in proximal relation to that receiving portion 22' of the filament stream 22. Scatter of particles along the filament stream is thereby controlled. The spacing between the pockets 410 and the speed of the wheel 400 is selected such that delivered charges 706 are consistently spaced apart as desired and/or in accordance with design specifications.

Additionally, the spacing of the pockets 210 along the rim 204 of the metering wheel 200 is selected such and the wheels synchronized such that as each pocket 210 of the metering wheel 200 approaches the angular transfer location 205 of the metering wheel 200, one the pockets 410 of the transfer wheel 400 arrives at the 11 o'clock angular position on the transfer wheel 400 so that each pocket 210 and 410 find themselves opposite one another at the angular transfer location 7.

By the time an empty pocket 410 arrives at the 11 o'clock position on the transfer wheel 400, the pocket 410 has been communicated with the vacuum plenum 420 so that the pocket 410 draws particle from the opposing pocket 210 and retains same against its screen 414.

The loaded pocket 410 remains subject to the vacuum plenum 420 so as to retain the load of particle as it rotationally traverses from the 11 o'clock position to a position just beyond a 5 o'clock angular location about the transfer wheel 400.

Upon further rotation of the transfer wheel 400, the loaded pocket moves ever closer to the delivery location 7 and passes into communication with an ambient plenum 430 which is vented to the surrounding environment so as to communicate ambient pressure to the pocket 410. By such arrangement, particles are more readily removed from the pocket 410 with minimal or no scatter.

After the pocket 410 has passed through the 7 o'clock position and its contents are released at the location 7, the pocket 410 passes into communication with a second vacuum plenum 440 which retains any lingering particulate matter within the pocket 410 until such time that it arrives at a purging station 450, where a stream of air is blown through the pocket 410 to purge same of any extraneous material before it arrives at the 11 o'clock position to receive another charge of particle from the metering wheel 200.

Preferably, the transfers of particles at locations about the system 10, including pick up and delivery of particles by the wheels 200 and 400 are undertaken in accordance with the teachings of the commonly assigned U.S. Pat. No. 5,339,871, which patent is hereby expressly incorporated by reference in its entirety.

It is presently preferred to render pockets 210 and 510 with rectangular openings at the respective locations along the rims of the metering wheel 200 and the transfer wheel 400.

Referring now to FIGS. 1 and 2, downstream of the closing shoe 700, a garniture belt 34 draws the closed, particle bearing filamentary stream 22*c* together with the plug wrap 32 past the tongue 802 of the continuous rod forming device 30, which preferably comprises a KDF2-E apparatus from Hauni-Körber AG of Hamburg, Germany.

Referring now to FIG. 3B, the vacuum retention wheel (drum) 600 itself includes individual spaced apart retention pockets 604 which communicate with a source of vacuum 500 in the region of the delivery position 7 adjacent the nip between the metering and vacuum retention wheels 400 and 600. These retention pockets 604 of the vacuum retention wheel 600 cause the tow fibrous mass to be pulled slightly into the individual pockets 604 so as to form a small depression thereat. Vacuum is maintained along the arcuate extent of the vacuum plenum 500, from at or just above the 3 o'clock position to at or just beyond the 11 o'clock position on the vacuum retention wheel 600 so that scatter of particles is minimized and precision of the desired placement of the particles at the spaced locations along the continuous fibrous stream 22 is facilitated.

Referring now to FIG. 2, preferably, the vacuum retention wheel 600 is vertically offset from the metering wheel 400 such that the continuous stream of fibrous tow 22 is firstly arched slightly upwardly toward the metering wheel 400 as it approaches the delivery location 7 and subsequently is then arched in an opposite way about the vacuum retention wheel 600 just beyond the delivery location 7 so as to facilitate a closing action upon the tow edge portions 702 and 704 about the individual charges of particles 706.

In another preferred embodiment, the vacuum retention wheel is placed vertically in line with the metering wheel and the toe is directed tangentially through the nip respective of both wheels 600 and 400.

Figure 5:
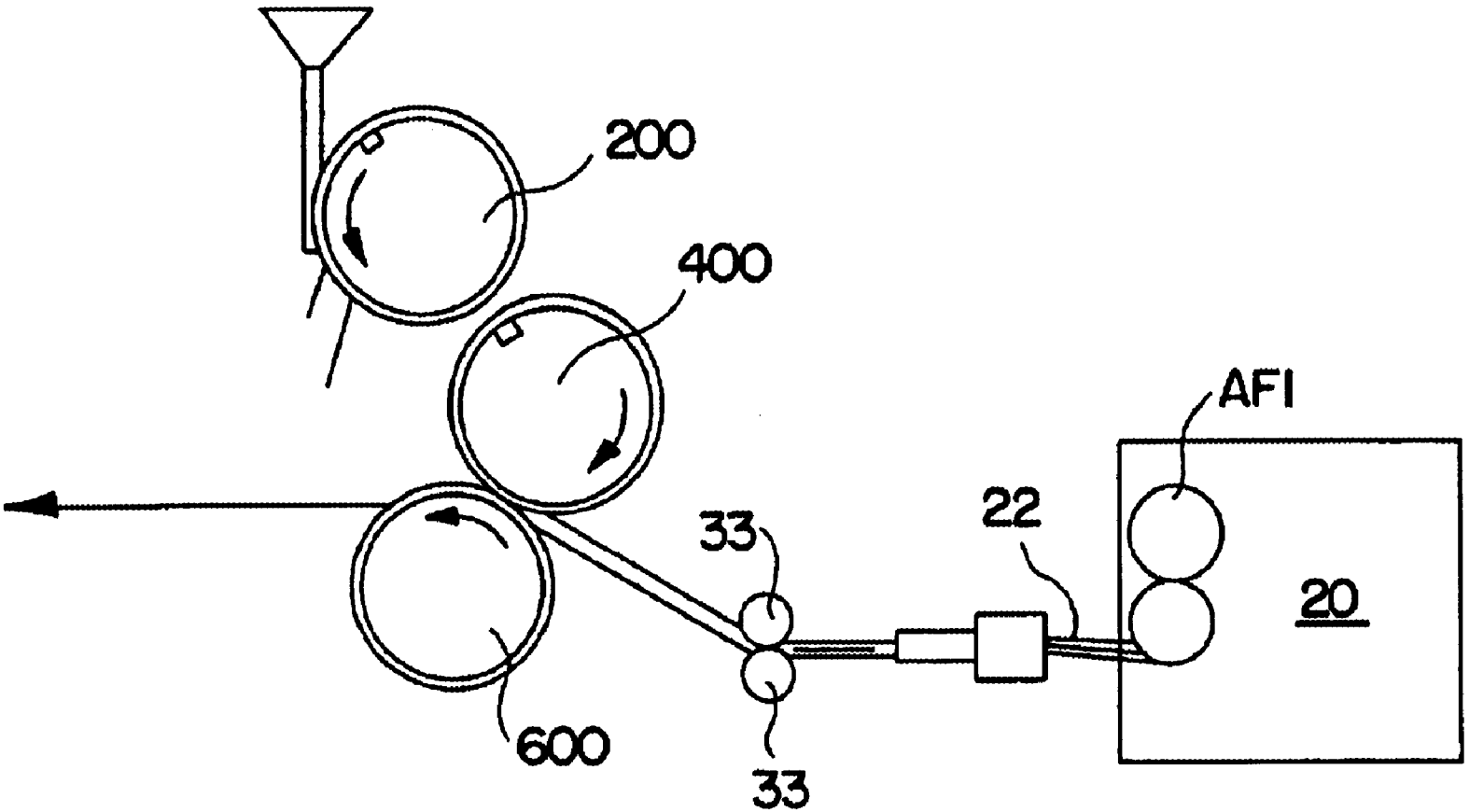
FIG. 5 is a schematic side view of portions of a filter rod maker system constructed in accordance with another preferred embodiment of the present invention.

Referring now to FIG. 5, another aspect of the present invention is to direct the output 22 of an AF1 through a transport jet 31, and using metering rollers 33 to assist feeding of the tow stream 22 toward the nip defined between vacuum retention wheel 600 and delivery wheel 400. Disposed between the metering rollers 33 and the vacuum retention wheel 600 is an opposing pair of planar guides to initiate a planar form to the fibrous tow mass 22.

Figure 6:
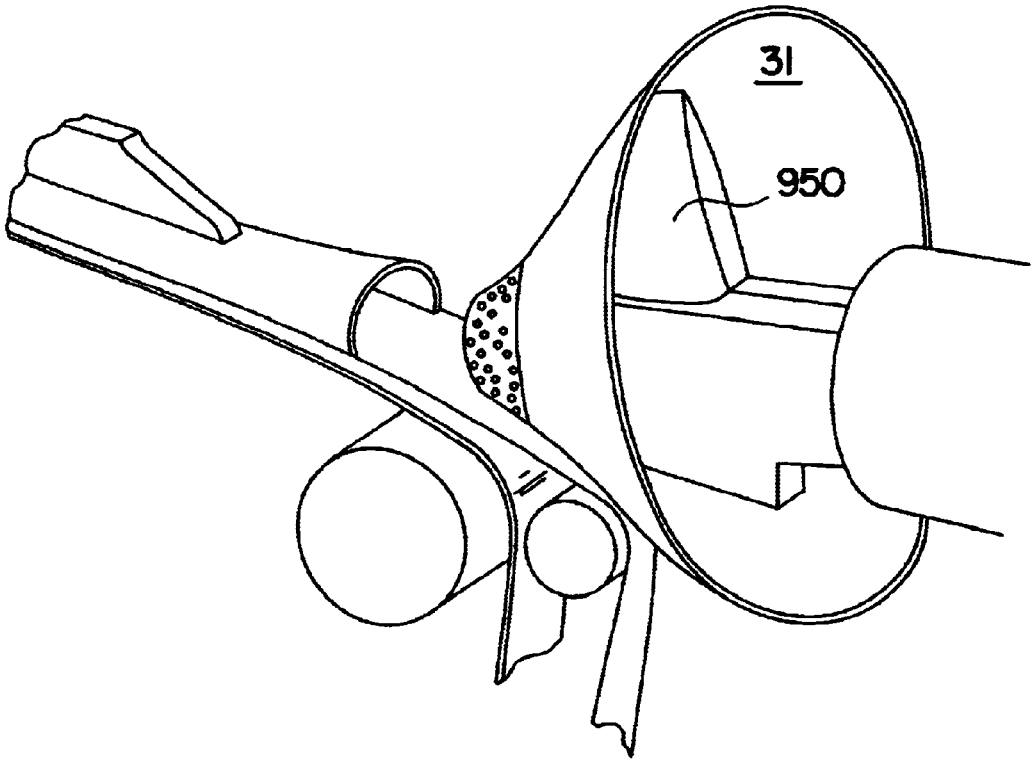
FIG. 6 is a perspective view of an optional transfer jet useful in the systems shown in FIGS. 1 and 5.

Referring now to FIG. 6, another aspect of the present invention is provision of a horn 950 at or about the transport jet 31 so as to initiate a general U-shaped parting in the continuous fibrous mass 22 as it passes through the transport jet 31. Guides 33 and/or rollers positioned operatively between the transport jet 31 and the vacuum retention wheel 600 then fold out the parted portions of the fibrous stream 22 to render a planar form to the fibrous stream 22 as it arrives the vacuum retention wheel 600.

Figure 7:
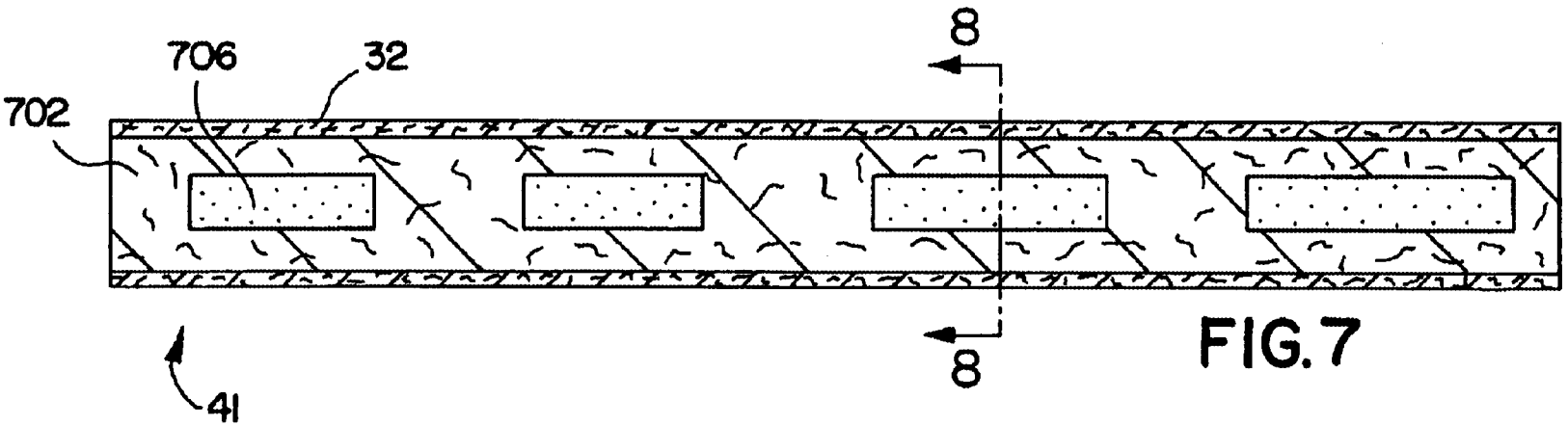
FIG. 7 is a cross-sectional side view of a 4-up cigarette filter plug constructed in accordance with systems such as shown in FIGS. 1 and 5.
Figure 8:
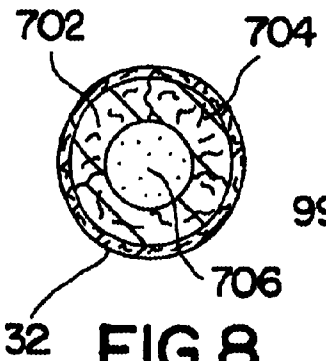
FIG. 8 is a cross-section as viewed from line 7—7 in FIG. 7.

Referring now to FIGS. 1 and 7, the rod maker apparatus 30 wraps the particle bearing, continuous strand 22*c* with the plug wrap 32 and seals the latter along the seam line 35 with an adhesive that is administered along the plug wrap 32 by a glue applicator 37. Once this continuous rod 22*d* is formed, the continuous rod enters the cutter 40 to be cut into individual filter plugs 41 of a predetermined length, such as a 4-up configuration as shown in FIG. 7 or other desired multiple or singular form. Action of the cutter 40 is preferably registered and synchronized with the action of the particle inserter apparatus 50 so that end portions of the plugs 41 are fibrous and the particle charges 706 are enclosed within each filter plug 41. As shown in FIG. 8, each filter plug 41 include fibrous portions 702, 704 which have been folded about a respective charge of particles 706.

Figure 9:
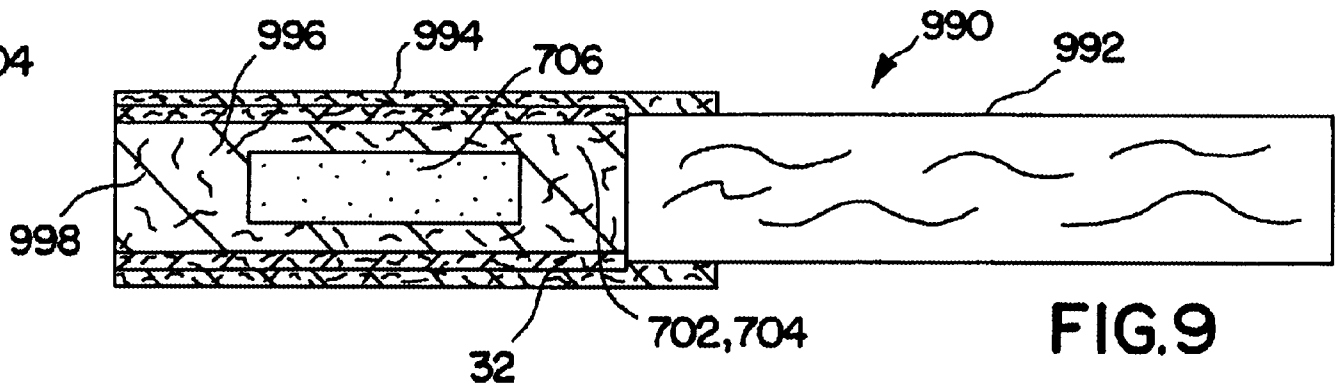
FIG. 9 is a filter cigarette constructed in accordance with a preferred embodiment of the present invention.

Referring to FIG. 9, a cigarette 990 constructed in accordance with a preferred embodiment of the present invention preferably includes a wrapped tobacco rod 992 which is attached by a tipping paper 994 to an individual filter 996 having a preferably a single charge of metered particulate material 706 within it and including folded portions 702, 704 of fibrous material adjacent thereto. Optionally a mouthpiece filter may be provided at the free end portion 998 of the filter 996.

In the alternative, the plasticizer applicator 28 may be operated intermittently and synchronously with the inserter apparatus 50 to apply the plasticizer (PZ) at locations along the continuous fibrous strand 22 other than locations 52*a, b,c*, etc where the stand 22 receives particles. In so doing, contact between the plasticizer and the charges of particles is minimized or wholly avoided so as to preserve the original state of the particles, such as the activated state of charcoal and/or silica gel or other adsorbent or reagent. In the alternative, the plasticizer applicator 28 may be operated downstream of the closing plow 700 so that the plasticizer is applied to outer portions of the closed, particle bearing fibrous stream 22*c*.

Figure 10:
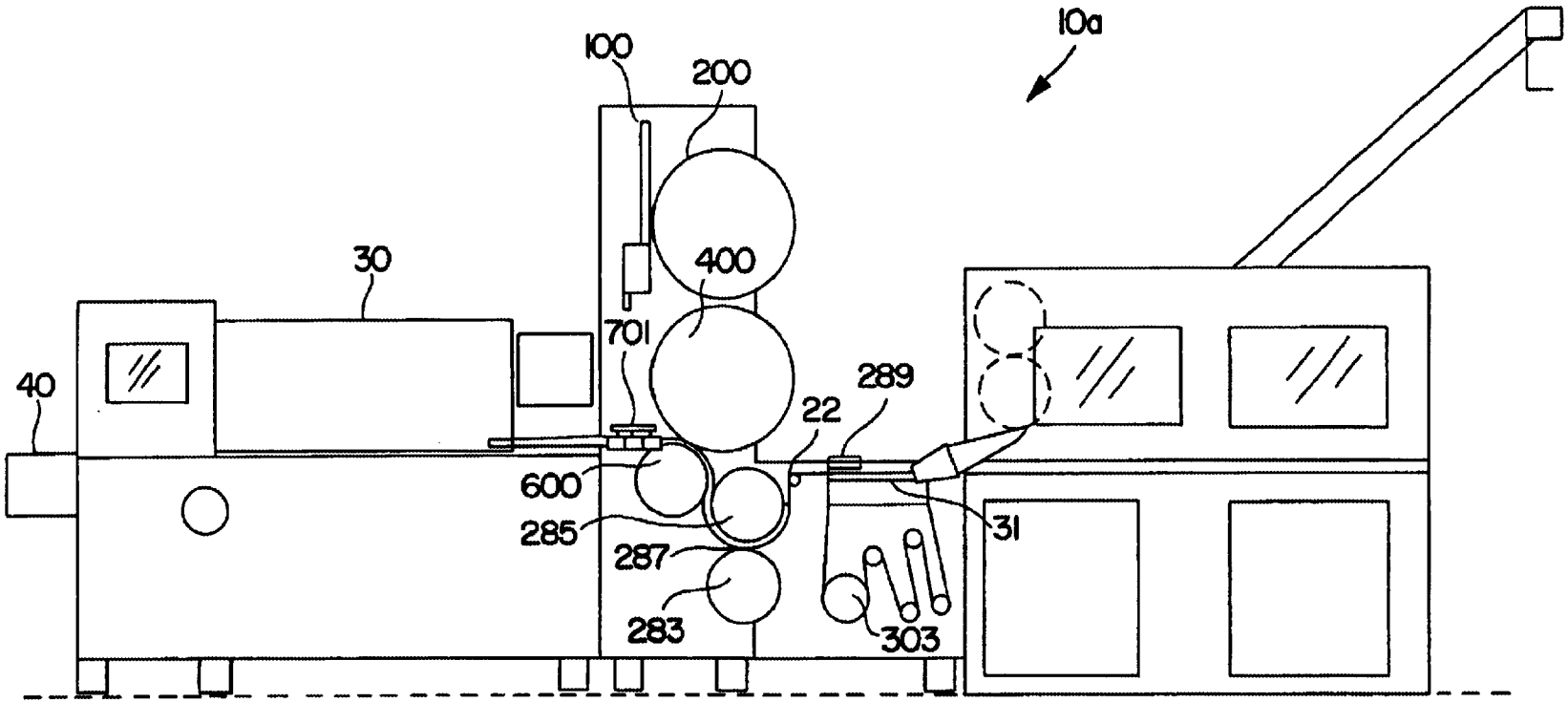
FIG. 10 is a schematic side view of a filter rod maker system constructed in accordance with another embodiment of the present invention.
Figure 11:
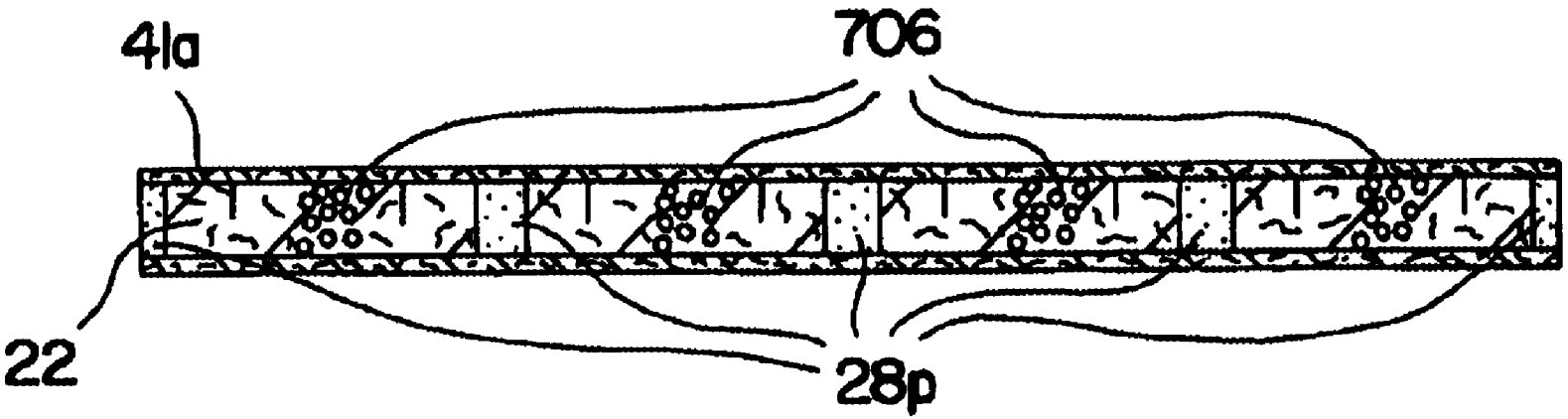
FIG. 11 is a cross-sectional side view of a 4-up cigarette filter plug constructed in accordance with systems such as shown in FIG. 10.

FIG. 10 shows a filter rod maker 10*a* that has been adapted for applying plasticizer in desired amounts and at precise locations along a continuous strand of fibrous material 22. The filter rod maker 10*a* permits manufacturing filter rods, such as the "four-up" filter rod 41 a shown in FIG. 11, having metered amounts of particulate material 706 disposed at precise intervals as well as plasticizer 28*p* disposed at precise intervals in alternating relation to the charges of the particulate material 706 and discrete from the particulate material so as to avoid deactivization of the particulate material through contact with the plasticizer. The filter rod 41*a* preferably has plasticizer 28*p* applied to the outer surface of the rod after the rod is closed around the particulate material 706, such as by conventional spraying or roller application techniques (not shown).

Figure 12:
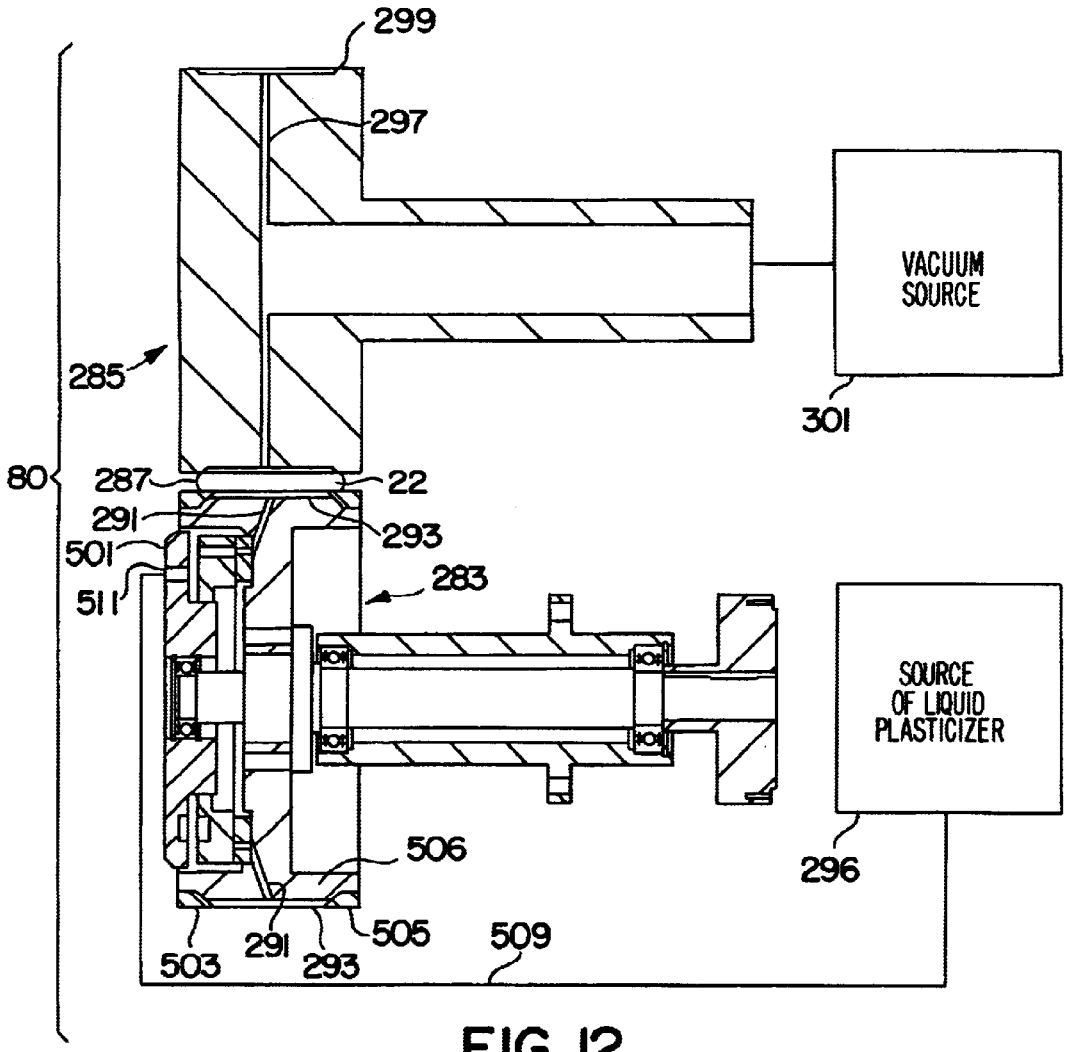
FIG. 12 is a schematic, partially cross-sectional, side view of a plasticizer application station according to an embodiment of the present invention.

The filter rod maker 10*a* of FIG. 10 differs from the filter rod maker 10 disclosed in FIG. 1 primarily though the addition of a plasticizer applicator or application station 280 (such as is shown in FIG. 12) having a plasticizer applicator 281 including a plasticizer wheel ("applicator drum") 283 and a plasticizer vacuum wheel 285 that, together, define a plasticizer nip 287 at which the plasticizer is preferably applied to the continuous strand of fibrous material 22. As shown in FIG. 10, the plasticizer application station 280 is preferably disposed upstream of the point at which the particulate material 706 is applied, however, if desired or necessary, the plasticizer application station can be disposed downstream of that point. In addition, the plasticizer application station 280 is preferably disposed downstream of a horn and/or plow and/or tongue 289 or other suitable structure for opening the continuous strand of fibrous material 22 and retaining it in an open condition prior to provision of the particulate material 706. Again, if desired or necessary, the plasticizer application station 280 can be disposed upstream of a plow 289 or similar structure, or downstream of structure that closes the continuous strand of fibrous material 22 prior to application of plug wrap 32 around the continuous strand of fibrous material if those operations are not performed simultaneously. Preferably, the plow 289 comprises a horn 950 as shown in FIG. 6.

The continuous stream of fibrous material 22 moves through the plasticizer station 280 along a path. As seen in FIG. 12, the plasticizer wheel 283 has a plurality of openings 291 extending to a radial surface 293 thereof and in flow communication with a source 295 of liquid plasticizer. The plasticizer vacuum wheel 285 has a plurality of openings 297 therein extending to a radial surface 299 thereof and in flow communication with a vacuum source 301. The plasticizer wheel 283 and the plasticizer vacuum wheel 285 are arranged relative to each other such that, as the continuous stream of fibrous material 22 moves through the plasticizer station 280 along the path, the nip 287 between the wheels defines a point on the path. When one of the plurality of openings 291 on the plasticizer wheel 283 is disposed in the nip 287, a corresponding one of the plurality of openings 297 on the plasticizer vacuum wheel 285 is also disposed in the nip on an opposite side of the continuous stream of fibrous material 22.

The source 296 of liquid plasticizer is preferably at or slightly above ambient pressure so that, ordinarily, plasticizer flows from the openings 291 either not at all or only at a very slow rate. If desired or necessary, the openings 291 may be arranged to communicate with the source 296 of liquid plasticizer only when the openings are disposed at or proximate the nip 287. Regardless what technique is used to limit the flow of plasticizer to the openings 291, when the openings 291 are opposite openings 297 on the plasticizer vacuum wheel 285 in the nip 287, the plasticizer is sucked toward the openings 297 and into the continuous stream of fibrous material 22. In this manner, precise application of the plasticizer to discrete areas of the continuous stream of fibrous material 22 remote from the particulate material 706 can be ensured. At least at the surfaces 293 and 297 of the wheels 283 and 285, respectively, the openings 291 and 297 are preferably substantially as wide as the continuous stream of fibrous material 22 so that plasticizer is applied substantially evenly across the continuous stream of fibrous material. It will, of course, be appreciated that the plasticizer application station 280 can be used independently of a particle charger apparatus 50, if desired or necessary.

Figure 13A:
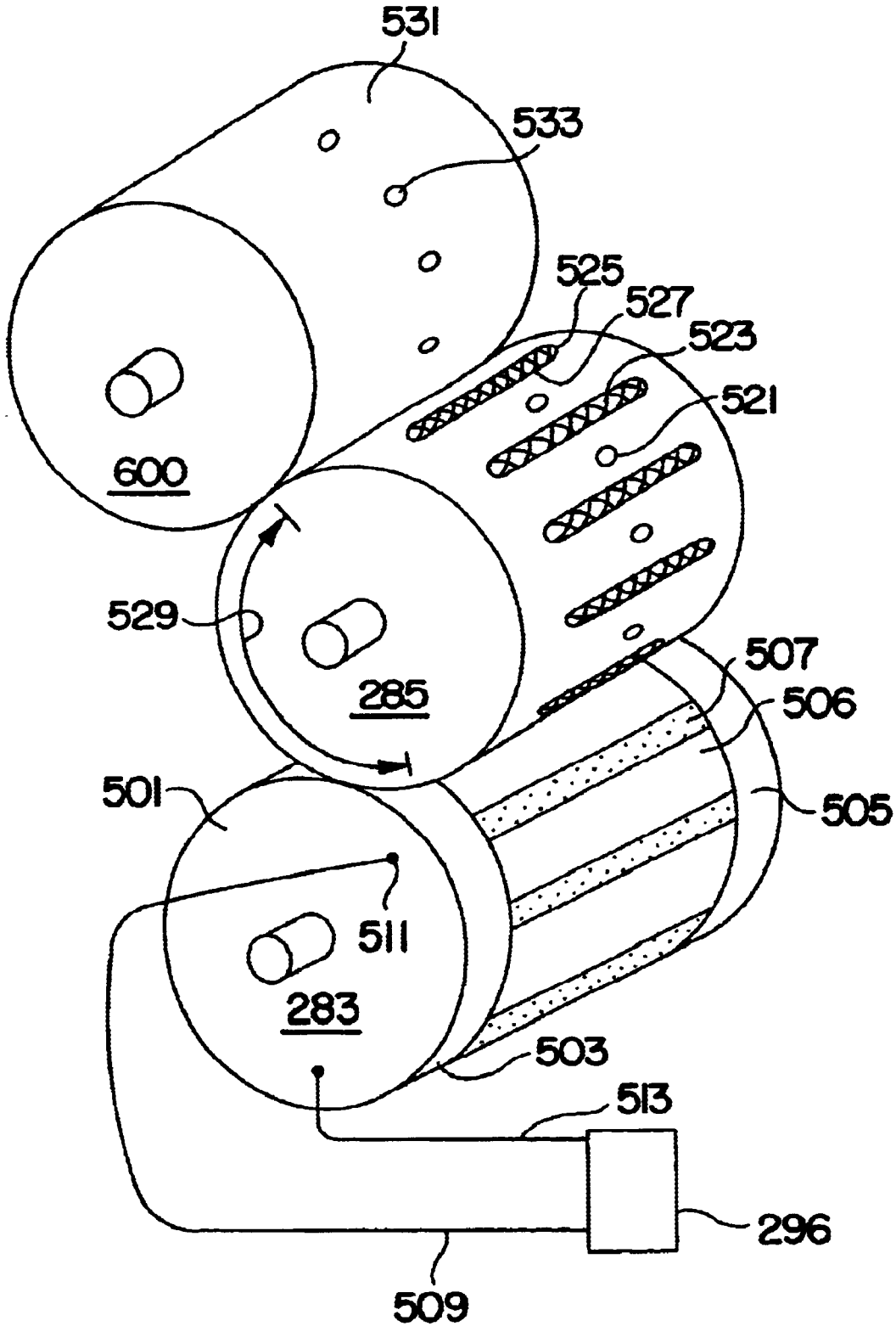
FIG. 13A is a schematic, perspective view of a portion of a plasticizer application station according to an embodiment of the present invention.

Referring now to FIGS. 12 and 13A, the applicator drum 283 preferably comprises a fixed face plate (disc) 501, fixed guide rings 503, 505 and a rotatably driven ring portion 506 of the applicator drum 283 disposed between the fixed guide rings 503, 505.

Preferably, the rotatable ring 506 comprises a plurality of spaced porous metallic segments 507 which are spaced apart about the circumference of the movable ring portion 506 at a value equal to the desired spacing for particles in the finished filter rod. For purposes of example, such spacing may be selected as 27 millimeter for many preferred cigarette filter designs. Preferably, the porous strips are approximately 3 to 8 mm wide, more preferably about 4 mm wide. They can be sourced from Mott Industrial, 84 Spring Lane, Farmington, Conn., USA 06032-3159, among other sources of porous strips. The preferred embodiment utilizes a 40 micron pore size with PZ; and other pore sizes may be selected for other plasticizers and/or machine-speeds.

Plasticizer (such as PZ) is preferably introduced from the source 296 into the applicator drum 283 through a line 509 and a port 511 on the fixed disk 501. Optionally, a drain line 513 is provided to return PZ from within the applicator drum 283 for return to the source 296 or alternatively to waste collection.

In this embodiment, each metallic porous segment 507 of the ring 506 is communicated with PZ supplied to an interior portion of the applicator drum 283 through the respective channel 291 (FIG. 10) as the respective segment 506 is rotated through the nip defined between the applicator drum 283 and the vacuum drum 285.

The vacuum drum 285 preferably includes a plurality of vacuum retention holes (or recesses) 521 disposed in alternating relation to a plurality of vacuum operated screened recesses 523. Preferably, the screened recesses 523 each comprise a slot of approximately 4–8 mm transverse length, more preferably about 5 mm transverse length, and a screen 527 recessed approximately 2 mm from the outer perimeter of the drum 285. Preferably the screened recesses 523 are spaced apart by a distance equal to that of the porous segments 507 of the applicator drum 283 and mesh with the same at the nip 287 between the drums 283 and 285.

Vacuum is communicated to the screened recesses from within the drum 285 preferably through the angular extent along drum 285 indicated by arrow 529 (in FIG. 13A) from a location adjacent the nip between the drums 285 and 283 and the nip between the drums 285 and 600. During such travel, each screened recess 523 applies vacuum to the locus where plasticizer has been applied by the applicator drum 285 so as to draw the plasticizer into the fibrous ribbon 22 and localize the plasticizer at or about the locus of application.

Preferably, each of the vacuum retention holes 521 are beveled (convergent radially inwardly) and are approximately ⅜" wide at the perimeter of the vacuum drum 285. Preferably, the retention holes 521 are communicated with vacuum throughout the arcuate extent that the continuous ribbon of tow 22 is in contact with the vacuum drum 285 which, in this embodiment, is from approximately a 2 o'clock position to an 11 o'clock position about the drum 285. Upon application of vacuum, local portions of the tow 22 are drawn partially into the holes 421 so as to enhance retention of the tow upon the vacuum drum 295 without slip. In that the holes 521 and the screened recesses 523 are operated along different angular extents, the holes 521 may be provided vacuum from a source (an exhaust fan) separate of that used for the screened recesses 523. Such an arrangement also minimizes risk of contamination should plasticizer be drawn through the screened recesses 523.

Figure 13B:
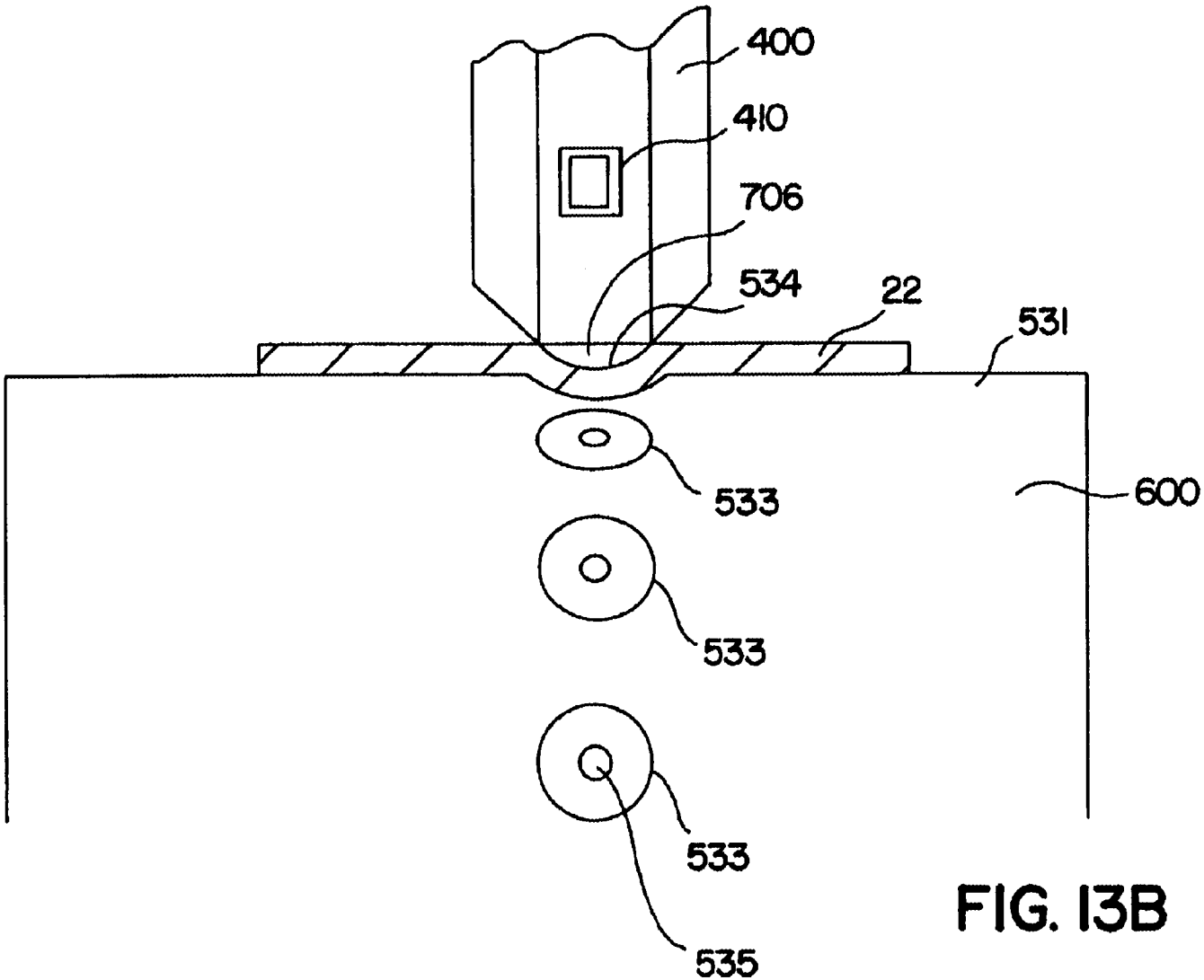
FIG. 13B is a schematic, partially cross-sectional view of a plasticizer application station according to an embodiment of the present invention.

Referring now also to FIG. 13B, in this embodiment the vacuum drum 600 includes a generally planar perimeter 531 which bears a plurality of spaced apart holes (or recesses) 533 that mesh with and are preferably similar to (in size and shape) the vacuum retention holes 521. Preferably both the holes 521 of the vacuum drum 285 and the holes 533 of the vacuum drum 600 include recessed screens 535 at the converged portion of beveled holes 521, 533. The vacuum applied through the holes 533 causes the fiber tow 22 to conform to the shape of the holes and the recessed screens 535 to form pocket-like recessed portions 534 capable of at least partially retaining an individual metered charge of particles 706. Vacuum is also applied to the holes 533 of the drum 600 so as to promote retention of the particles 706. Preferably, the application of vacuum is continued beyond the nip defined between the delivery wheel 400 and the vacuum drum 600 and to where closing of the strand 22 is a least partially effected. Both sets of holes 521, 533 contribute positive retention of the ribbon of tow 22 without slip so that registration between locations for particles and plasticizer and the cutter is maintained.

Preferably, the ribbon 22 is retained in a generally uncurled state as it passes through the nip between the delivery wheel 400 and the vacuum drum 600. Thereafter, it is preferably folded about the charge of particles 706 immediately beyond the nip by rollers and/or ploughs so as to avoid spillage of particles. Folding is preferably initiated before the release of vacuum upon a given recess as is further described with reference to FIGS. 18A and 18B.

Figure 14:
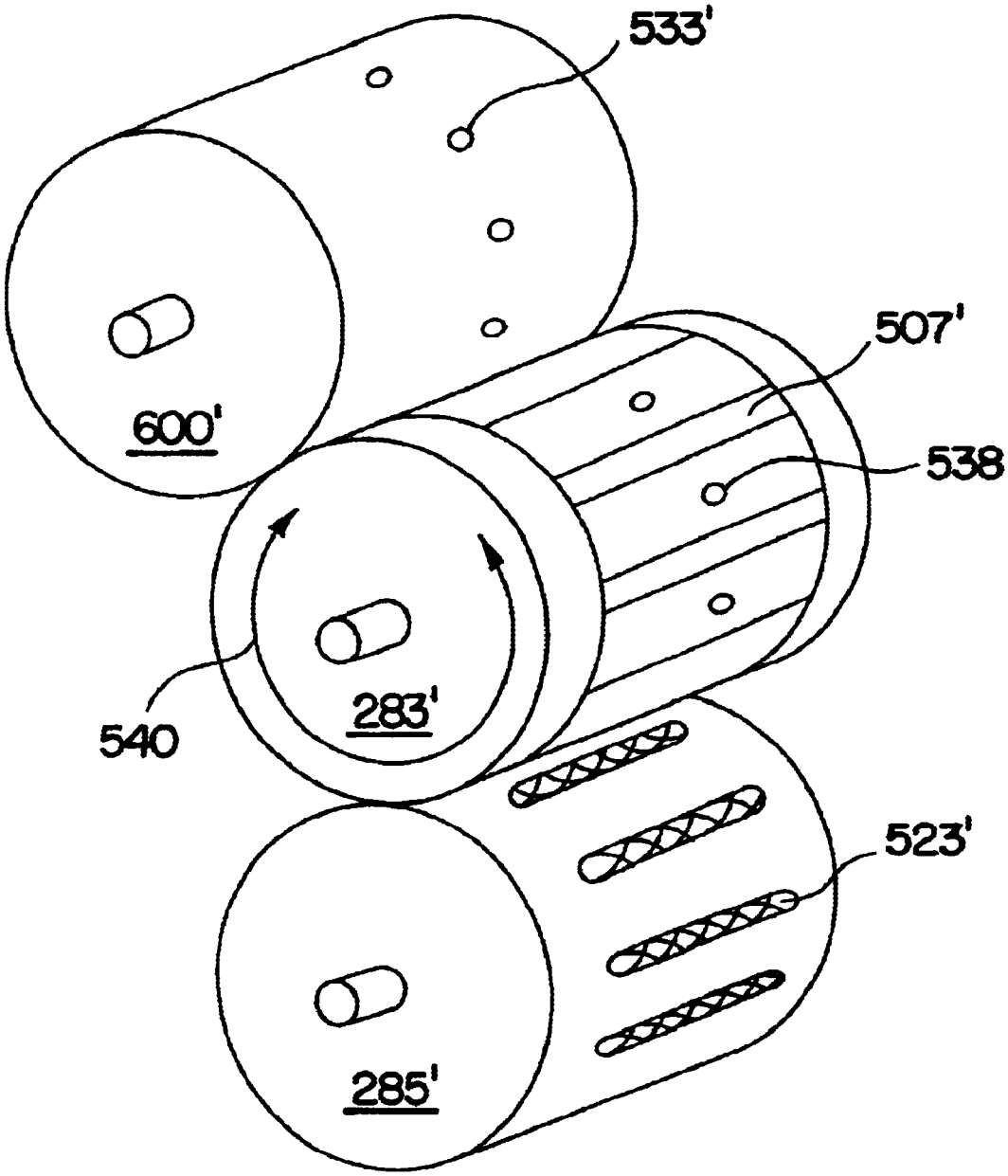
FIG. 14 is a schematic, perspective view of a portion of a plasticizer application station according to an embodiment of the present invention.

Referring now to FIG. 14, another preferred embodiment includes exchange of the locations of the applicator drum 283' and the vacuum 285', but with an absence of holes between the porous segments 507' on the vacuum drum 295' and, optionally, the addition of retention holes 538 on the applicator drum 283', which holes 538 mesh with and are similar to the retention vacuum holes 533' of the vacuum drum 600'. In this embodiment, the porous segments 507' can be communicated with the supply of plasticizer throughout the angular extent that the ribbon of tow 22 is retained along the drum 283', as indicated by arrow 541 in FIG. 14, or portions thereof. This embodiment also advantageously applies plasticizer to an inside surface of the tow 22.

Figure 15:
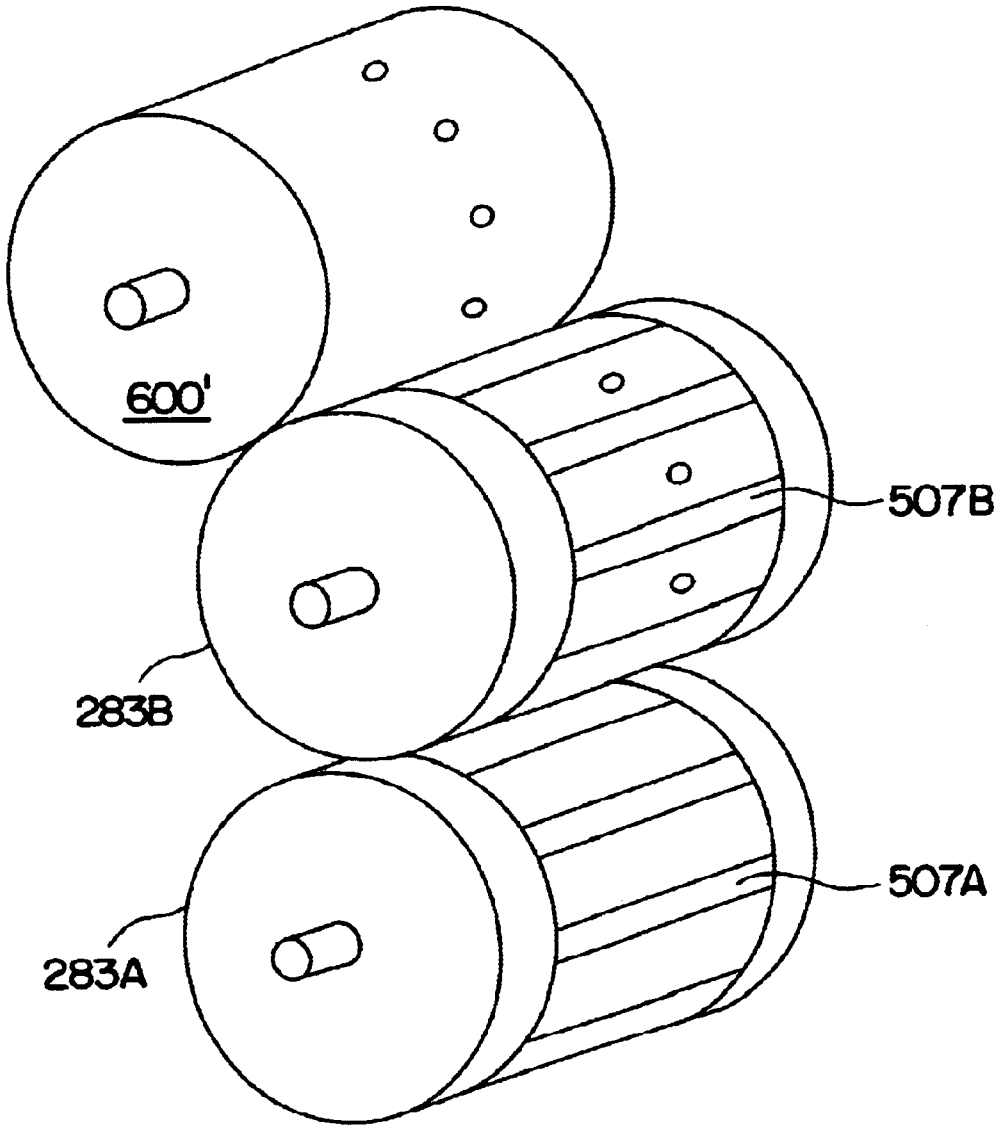
FIG. 15 is a schematic, perspective view of a portion of a plasticizer application station according to an embodiment of the present invention

Referring now to FIG. 15, another embodiment replaces the vacuum cylinder of the embodiment shown in FIG. 14 with a secondary, lower applicator drum 283A such that the porous segments 507A of the lower drum 283A and the segments 507B of the upper drum 283B mesh at the nip so as to apply plasticizer to both sides of the tow 22.

It is to be realized that the retention holes 533 of the drum 600 operate as the individual pockets 604 described above with reference to FIG. 3B.

Figure 16:
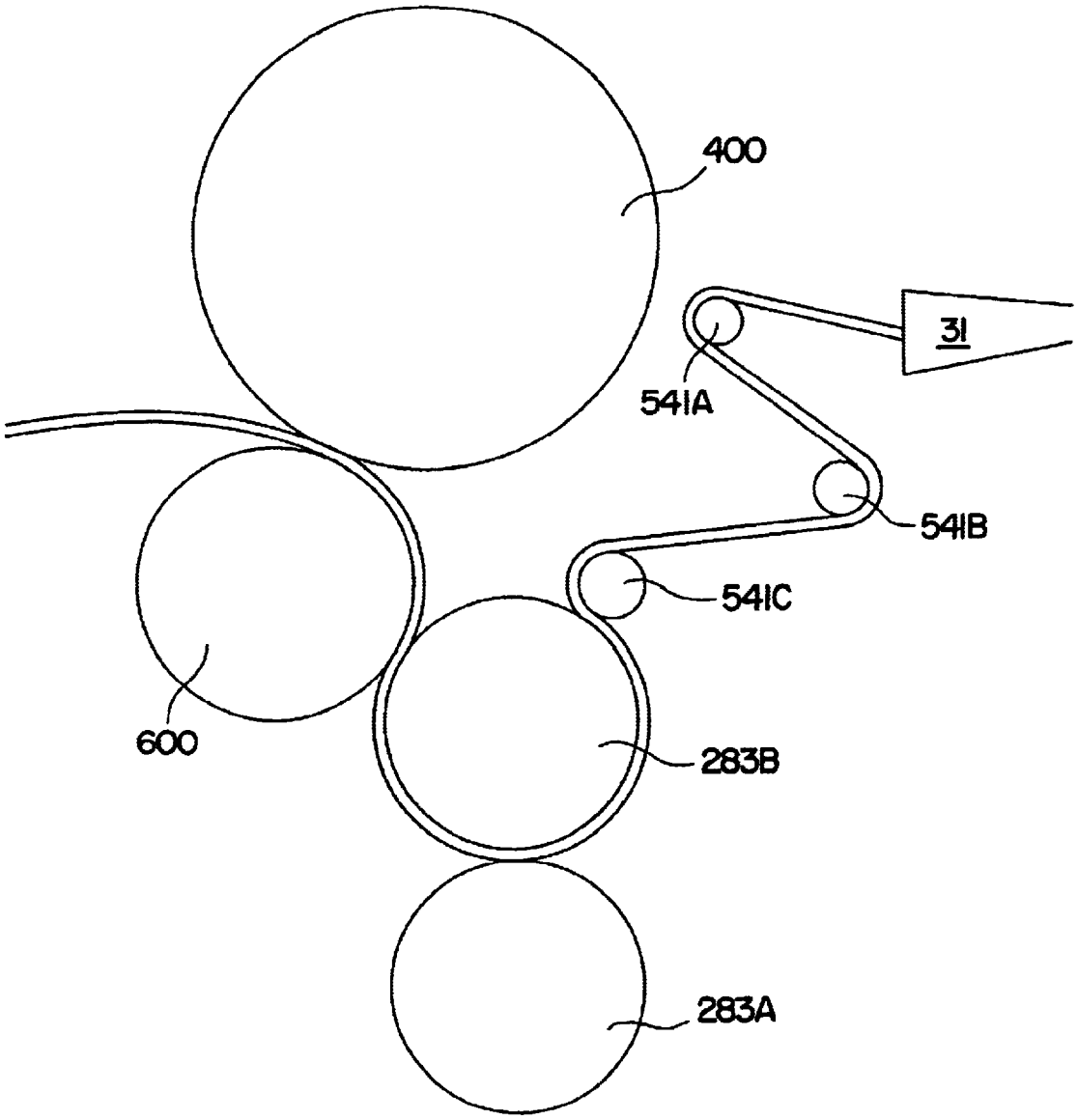
FIG. 16 is a schematic, side view of a portion of a plasticizer application station according to an embodiment of the present invention.

Referring now to FIG. 16, operation of the embodiment shown in FIG. 15 (and any of the other embodiments) may include passing the output of the transport jet 31 over a series of conical rollers 541A, 541 B, and 541C to promote transverse spreading of the stream of tow 22. Other expedients such as angulated pairs of rollers, ploughs, or other surfaces may be used to help spread the tow transversely.

Figure 17B:
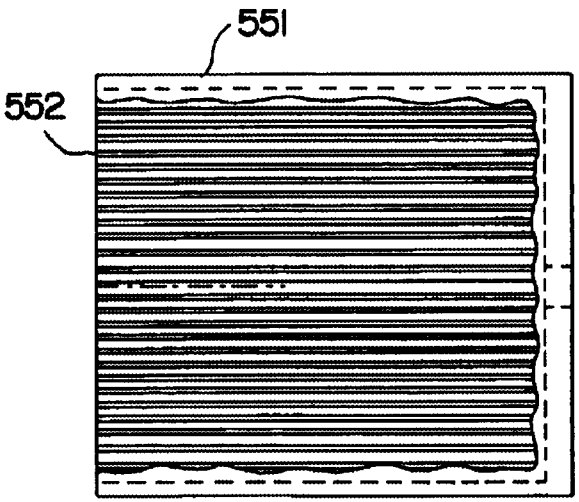
FIG. 17B is a schematic, frontal view of a slotted rotatable drum according to an embodiment of the present invention.
Figure 17A:
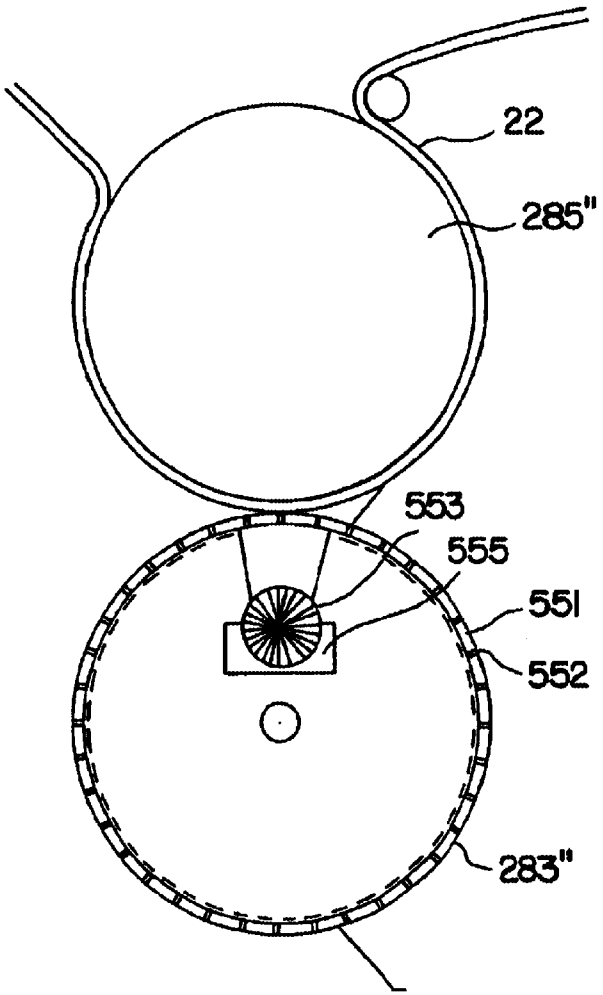
FIG. 17A is a schematic, side view of a portion of a plasticizer application station according to an embodiment of the present invention.

Referring now to FIGS. 17A and 17B, the plasticizer applicator drum 283" includes a slotted rotatable drum portion 551, whose slots 552 are spaced apart according to the preferred spacing of plasticizer applications (e.g., 27 mm, if preferred). A rotatable brush applicator 553 is disposed within the drum which picks up plasticizer from a reservoir 555 and directs same to the nip between the rotatable drum 551 and the opposing vacuum drum 285".

In the alternative, a rotating slotted disk or a perforated or slotted endless belt may be interposed between a spray brush or nozzle and the continuous band of tow 22 so as to establish a repeated, discrete application of plasticizer. Alternatives further include a plurality of applicator nozzles whose discharges are sequenced or a brush having spaced apart bunches of bristles.

As seen in FIG. 10, a second tube belt drive arrangement 303 is preferably provided to facilitate advancing the continuous stream of fibrous material 22 after its establishment at the transport jet 31. The continuous stream of fibrous material 22 is preferably advanced with minimal tension and, therefore, it is preferably supported on a belt or roller during a substantial portion of its transmission from the jet 31 to the point at which it is wrapped in plug wrap 32.

The continuous stream of fibrous material 22 is, in addition, preferably held to the various vacuum rollers 285 and 600. The vacuum assisted grip of these rollers 285 and 600 helps maintain registration between particle and plasticizer applications and cutting operations. In this way, tension in the continuous stream of fibrous material is minimized, thereby minimizing problems associated with the continuous stream of fibrous material retaining a bent shape as the result of being bent around curves under tension. Conventional garniture devices may also be replaced with closing wheels 701 that permit closing of the continuous stream of fibrous material 22 under minimal tension.

Figure 18A:
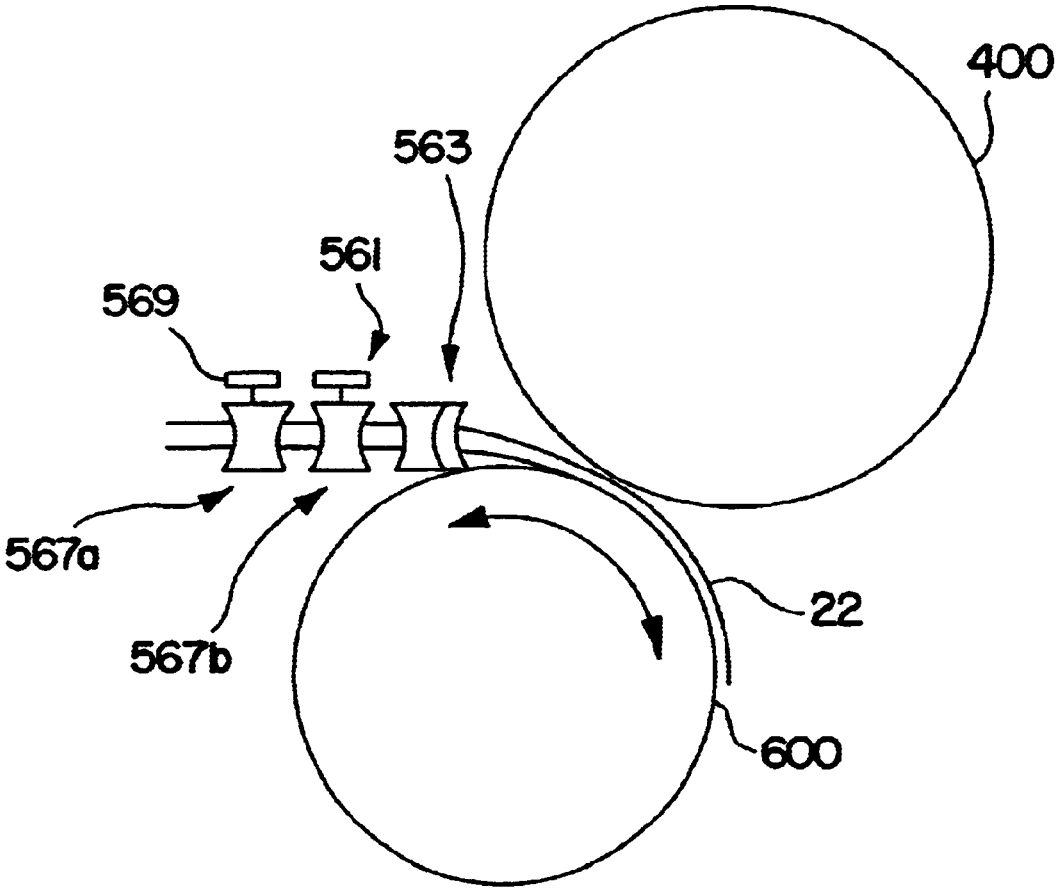
FIG. 18A is a side view of folding rollers according to an embodiment of the present invention.
Figure 18B:
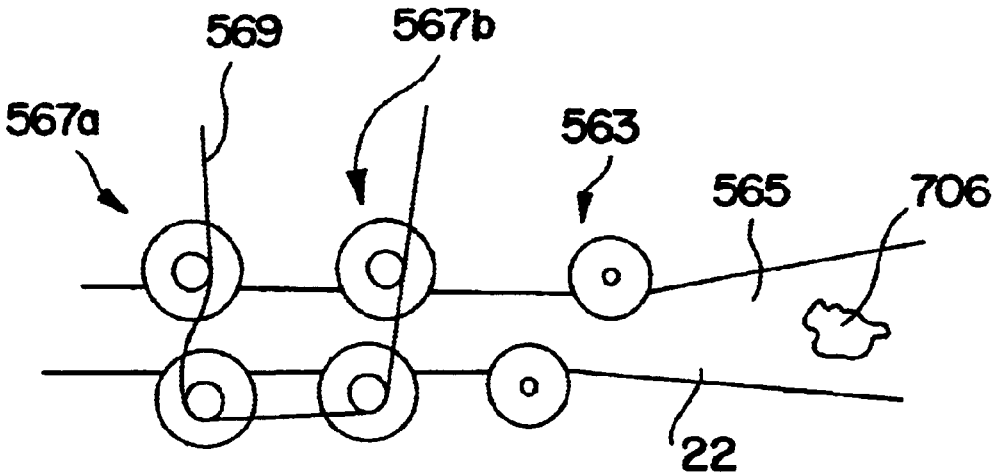
FIG. 18B is a top view of folding rollers according to an embodiment of the present invention.

Referring now to FIGS. 18A and 18B, preferably a plurality of rollers 561 are disposed immediately downstream of the vacuum drum 600 for initiating and completing the closing of the tow strand 22 about the intermittent charges of particles 706. Preferably, the rollers 561 include a first, offset pair of idler rollers 563 such that folding action is initiated first on one side 565 of the tow strand 22 and then the other. Preferably the first offset roller pair 563 are followed by one or more pairs of opposing concave rollers 567*a* and 567*b* which are driven by a belt 569 or by other suitable drive arrangement. The downstream rollers 567*a* and 567*b* complete the folding action of portions of the tow strand 22 about the discrete spaced apart charges 706.

Preferably, the application of vacuum to the retention holes 533 on the vacuum drum 600 extends arcuately along an extent (represented by arrow 571 in FIG. 18A) where the tow 22 first contacts the drum 600 (at approximately a 4 o'clock position in the preferred embodiment) to a location where the folding action of the rollers 563 has at least partially folded portions of the tow strand 22 about the respective charge of particles 706. Accordingly, it is preferred to maintain vacuum on the holes 533 of the drum 600 to approximately the 11 o'clock position on the drum 600. By such an arrangement, particles are prevented from escaping the strand 22 during folding.

One skilled in the art will appreciate that the present invention may be practiced by other than the described embodiments, which were presented for purposes of illustration and not of limitation. One skilled in the art would recognize that the device and the methodologies embodied therein are adaptable to delivering various types of particulate or granular material and could be used in applications other than the filling of cigarette filters. For example, the device is readily adaptable to the filling of pharmaceuticals, or the repetitive placement of powdered foods or other powdered products into discrete packaging or containers. In cigarette applications, the particles may include flavorants or, in addition or in the alternative, the plasticizer may include or be replaced with flavorants.

What is claimed is:

1. A system for manufacturing a filter, comprising:

an arrangement for establishing a continuous strand of material and moving the strand along a path:

a particle delivery arrangement for repetitively drawing a metered amount of particulate material at a first location and releasing the drawn, metered amount of particulate material at a delivery location, the delivery location being along the strand path;

the establishing arrangement including a unit located upstream of the delivery location for at least partially opening the established continuous strand of fibrous material so that at the delivery location the released particulate material is released into the at least partially opened continuous strand, whereby a particle location is defined along the strand;

a unit located downstream of the delivery location for closing the at least partially opened continuous strand of fibrous material so as to fixedly capture the metered, released particulate material at the particle location in the closed strand; and a first drum adjacent the delivery location, the drum including a plurality of vacuum communicating holes along a perimeter of the drum adapted to form a recess at spaced locations along the continuous strand of fibrous material, wherein the first drum is located beneath the continuous strand of fibrous material at the delivery location such that the released particulate material is at least partially received in one of the recesses at the delivery location.

2. The system as claimed in claim 1, further comprising a cutter downstream of the closing unit for cutting the continuous, particle bearing, fibrous rod into discrete rod plugs.

3. The system as set forth in claim 1, wherein the closing unit is arranged adjacent the drum so that closing action of the closing unit initiates coextensively with vacuum communication to the recesses.

4. The system as set forth in claim 1, further comprising a fluid application station, the fluid application station being disposed between the closing unit and the establishing arrangement, for applying the fluid to the continuous stream of fibrous material at locations along the continuous stream apart from the released particulate matter.

5. The system as set forth in claim 4, wherein the fluid application station is disposed upstream of the particle delivery arrangement.

6. The system as set forth in claim 4, wherein the fluid application station is disposed downstream of the particle delivery arrangement.

7. The system as set forth in claim 4, wherein the delivery arrangement comprises a delivery wheel, the delivery wheel including a plurality of spaced apart pockets, the pockets being in opposing relation to the vacuum communicating holes of the first drum at the delivery location.

8. The system as set forth in claim 7, wherein the delivery arrangement further comprises a metering wheel arranged to repetitively transfer charges of particles to the pockets of the delivery wheel.

9. The system as set forth in claim 1, wherein the first drum and the closing unit are arranged relative to each other such that closing the continuous strand of fibrous material is initiated while a vacuum is applied to the continuous strand of fibrous material through the vacuum communicating holes.

10. A system for manufacturing a filter, comprising:

an arrangement for establishing a continuous strand of material and moving the strand along a path;

a particle delivery arrangement for repetitively drawing a metered amount of particulate material at a first location and releasing the drawn, metered amount of particulate material at a delivery location, the delivery location being along the strand path;

the establishing arrangement including a unit located upstream of the delivery location for at least partially opening the established continuous strand of fibrous material so that at the delivery location the released particulate material is released into the at least partially opened continuous strand, whereby a particle location is defined along the strand;

a unit located downstream of the delivery location for closing the at least partially opened continuous strand of fibrous material so as to fixedly capture the metered, released particulate material at the particle location in the closed strand a first drum adjacent the delivery location, the drum including a plurality of vacuum communicating holes along a perimeter of the drum for imparting a recess at spaced locations along the continuous strand of fibrous material, whereby the released particulate material is at least partially received in one of the recesses at the delivery location;

and a fluid application station disposed between the closing unit and the establishing arrangement for applying the fluid to the continuous stream of fibrous material at locations along the continuous stream apart from the released particulate matter, wherein the continuous stream of fibrous material moves through the fluid application station along a second path, and the fluid station includes a fluid applicator portion that is movable with the continuous stream of fibrous material along at least a portion of the second path.

11. The system as set forth in claim 10, wherein the fluid comprises a plasticizer the fluid application station includes a first wheel having a plurality of openings extending to a radial surface thereof and in flow communication with a source of liquid plasticizer, and a second wheel having a plurality of openings therein extending to a radial surface thereof and in flow communication with a vacuum source, the first and second wheel being arranged relative to each other such that, as the continuous stream of fibrous material moves through the plasticizer station along the second path, a nip between the first and second wheel defines a location on the second path and, when one of the plurality of openings on the first wheel is disposed in the nip, a corresponding one of the plurality of openings on the second wheel is also disposed in the nip on an opposite side of the continuous stream of fibrous material.

12. A system for manufacturing a filter, comprising:

an arrangement for establishing a continuous strand of material and moving the strand along a path;

a particle delivery arrangement for repetitively drawing a metered amount of particulate material at a first location and releasing the drawn, metered amount of particulate material at a delivery location, the delivery location being along the strand path;

the establishing arrangement including a unit located upstream of the delivery location for at least partially opening the established continuous strand of fibrous material so that at the delivery location the released particulate material is released into the at least partially opened continuous strand, whereby a particle location is defined along the strand;

a unit located downstream of the delivery location for closing the at least partially opened continuous strand of fibrous material so as to fixedly capture the metered, released particulate material at the particle location in the closed strand a first drum adjacent the delivery location, the drum including a plurality of vacuum communicating holes along a perimeter of the drum for imparting a recess at spaced locations along the continuous strand of fibrous material, whereby the released particulate material is at least partially received in one of the recesses at the delivery location;

and a fluid application station disposed between the closing unit and the establishing arrangement for applying the fluid to the continuous stream of fibrous material at locations along the continuous stream apart from the released particulate matter, wherein the delivery arrangement comprises a delivery wheel, the delivery wheel including a plurality of spaced apart pockets, the pockets being in opposing relation to the vacuum communicating holes of the first drum at the delivery location, and wherein the fluid applicator comprises a second drum and a third drum in mutually opposing relation along the strand path, at least one of the drums including fluid transferring portions at spaced locations along a rotatable perimeter thereof.

13. The system as set forth in claim 12, wherein the both the second and third drums included fluid transferring portions.

14. The system as set forth in claim 13, wherein the fluid transferring portions of the second drum mesh with fluid transferring portions of the second drums at a nip defined between the second and third drums.

15. The system as claimed in claim 12, wherein the other of the second and third drum includes vacuum communicating portions at spaced locations along a rotatable perimeter thereof, the vacuum communicating portions meshing with the fluid transferring portions at a nip defined between the second and third drums.

16. The system as claimed in claim 12, wherein at least one of the drums includes a plurality of vacuum communicating retention holes.

17. A system for manufacturing a filter, comprising:

an arrangement for establishing a continuous strand of material and moving the strand along a path;

a particle delivery arrangement for repetitively drawing a metered amount of particulate material at a first location and releasing the drawn, metered amount of particulate material at a delivery location, the delivery location being along the strand path;

the establishing arrangement including a unit located upstream of the delivery location for at least partially opening the established continuous strand of fibrous material so that at the delivery location the released particulate material is released into the at least partially opened continuous strand, whereby a particle location is defined along the strand;

a unit located downstream of the delivery location for closing the at least partially opened continuous strand of fibrous material so as to fixedly capture the metered, released particulate material at the particle location in the closed strand a first drum adjacent the delivery location, the drum including a plurality of vacuum communicating holes along a perimeter of the drum for imparting a recess at spaced locations along the continuous strand of fibrous material, whereby the released particulate material is at least partially received in one of the recesses at the delivery location;

and a fluid application station disposed between the closing unit and the establishing arrangement for applying the fluid to the continuous stream of fibrous material at locations along the continuous stream apart from the released particulate matter, wherein the delivery arrangement comprises a delivery wheel, the delivery wheel including a plurality of spaced apart pockets, the pockets being in opposing relation to the vacuum communicating holes of the first drum at the delivery location, and wherein the closing unit comprises at least a pair of rollers located adjacent the first drum.

18. The system as set forth in claim 17, wherein the first drum and the rollers are mutually arranged so that the rollers initiate folding of portions of the strand about released particulate material while the released particulate material is retained in one of the recesses formed by the vacuum communicating holes of the first drum.

19. A system for the production of particle bearing filters comprising:

a treatment apparatus arranged to produce a continuous stream of fibrous material;

a fibrous rod maker at a second location downstream of the treatment apparatus for wrapping a plug wrap about the continuous stream of fibrous material and sealing the plug wrap wrapped about the continuous stream of fibrous material;

a particle inserter operative at a location between the rod maker and the tow treatment apparatus for inserting predetermined, metered amounts of particles in spaced, discrete locations along the continuous stream of fibrous material;

the particle inserter being arranged so that the particles are delivered by first establishing a continuous stream of fibrous material along a feed path; establishing a flow of particles along a first path; moving a first pocket along an endless path at least partially coinciding with the first path; drawing an amount of the particles into the pocket as the pocket moves in proximate relationship with the particles flow; transferring the drawn amount of particles from the first pocket to a second pocket while moving the second pocket along a second endless path which coincides with the feed path at a release location; curling a portion of the continuous stream of fibrous material upstream of the release location; releasing the drawn amount of particles from the second pocket into the curled portion of the continuous stream of fibrous material at the release location; and subsequently closing the curled portion of the continuous stream of fibrous material about the released, drawn amount of particles; further comprising a drum adjacent the release location, the drum including a plurality of vacuum communicating recesses for imparting a cupped shape at spaced locations along the fibrous material, whereby the released drawn amount of particulate material is at least partially received in one of the cupped shaped portions of the fibrous material at the release location.

20. The system as claimed in claim 19, further comprising a cutter downstream of the filter rod maker for cutting the continuous, particle bearing, fibrous rod into discrete rod plugs.

21. The system as claimed in claim 19, wherein tow treatment apparatus is configured to produce a continuous ribbon of fibrous material.

22. The system as set forth in claim 19, further comprising a plasticizer application station disposed between the rod maker and the tow treatment apparatus for applying plasticizer to the continuous stream of fibrous material at locations apart from the amounts of particles.

23. The system as set forth in claim 22, wherein the plasticizer application station is disposed upstream of the particle inserter.

24. The system as set forth in claim 23, wherein the plasticizer station is disposed downstream of the particle inserter.

25. The system as claimed in claim 19, wherein a chute is in communication with a reservoir, the chute adjacent the metering wheel.

26. The system as claimed in claim 19, wherein the metering wheel comprises a rim and a plurality of radially-inwardly directed, metering pockets at spaced locations about the rim.

27. The system as claimed in claim 19, wherein the rim includes a plurality of channels, the channels arranged to communicate the metering pockets with an interior of the metering wheel, the metering pockets communicating with the channels through a plurality of screens, the metering pockets following a first rotational path upon rotation of the metering wheel.

28. A system for the production of particle bearing filters comprising:

a treatment apparatus arranged to produce a continuous stream of fibrous material;

a fibrous rod maker at a second location downstream of the treatment apparatus for wrapping a plug wrap about the continuous stream of fibrous material and sealing same;

a particle inserter operative at a location between the rod maker and the tow treatment apparatus for inserting predetermined, metered amounts of particles in spaced, discrete locations along the continuous stream of fibrous material;

the particle inserter being arranged so that the particles are delivered by first establishing a continuous stream of fibrous material along a feed path; establishing a flow of particles along a first path; moving a first pocket along an endless path at least partially coinciding with the first path; drawing an amount of the particles into the pocket as the pocket moves in proximate relationship with the particles flow; transferring the drawn amount of particles from the first pocket to a second pocket while moving the second pocket along a second endless path which coincides with the feed path at a release location; curling a portion of the continuous stream of fibrous material upstream of the release location; releasing the drawn amount of particles from the second pocket into the curled portion of the continuous stream of fibrous material at the release location; and subsequently closing the curled portion of the continuous stream of fibrous material about the released, drawn amount of particles;

a plasticizer application station disposed between the rod maker and the tow treatment apparatus for applying plasticizer to the continuous stream of fibrous material at locations apart from the amounts of particles, wherein continuous stream of fibrous material moves through the plasticizer station along a second path, and the plasticizer station includes a plasticizer applicator that is movable with the continuous stream of fibrous material along at least a portion of the second path.

29. The system as set forth in claim 28, wherein the plasticizer applicator includes a first wheel having a plurality of openings extending to a radial surface thereof and in flow communication with a source of liquid plasticizer, and a second wheel having a plurality of openings therein extending to a radial surface thereof and in flow communication with a vacuum source, the first and second wheel being arranged relative to each other such that, as the continuous stream of fibrous material moves through the plasticizer station along the second path, a nip between the first and second wheel defines a location on the second path and, when one of the plurality of openings on the first wheel is disposed in the nip, a corresponding one of the plurality of openings on the second wheel is also disposed in the nip on an opposite side of the continuous stream of fibrous material.

* * * * *